US011548603B2

(12) United States Patent
Crawford et al.

(10) Patent No.: US 11,548,603 B2
(45) Date of Patent: Jan. 10, 2023

(54) SYSTEMS AND METHODS FOR ROTATIONAL CONTROL OF A TROLLING MOTOR

(71) Applicant: NAVICO HOLDING AS, Egersund (NO)

(72) Inventors: Christopher D. Crawford, Bixby, OK (US); Guy Coonts, Ripley, OK (US); Peter VerBrugge, Tulsa, OK (US)

(73) Assignee: NAVICO HOLDING AS, Egersund (NO)

( * ) Notice: Subject to any disclaimer, the term of this patent is extended or adjusted under 35 U.S.C. 154(b) by 58 days.

(21) Appl. No.: 17/332,036

(22) Filed: May 27, 2021

(65) Prior Publication Data

US 2021/0284310 A1 Sep. 16, 2021

Related U.S. Application Data

(63) Continuation of application No. 16/795,661, filed on Feb. 20, 2020, now Pat. No. 11,046,408.

(51) Int. Cl.
*B63H 20/12* (2006.01)
*B63H 20/00* (2006.01)

(52) U.S. Cl.
CPC ..... *B63H 20/12* (2013.01); *B63H 20/007* (2013.01)

(58) Field of Classification Search
CPC ..... B63H 20/12; B63H 20/007
See application file for complete search history.

(56) References Cited

U.S. PATENT DOCUMENTS

| | | | | |
|---|---|---|---|---|
| 3,241,380 | A | 3/1966 | Howing | |
| 3,310,021 | A | 3/1967 | Shimanckas | |
| 4,610,632 | A | 9/1986 | Osborne | |
| 7,538,511 | B2 | 5/2009 | Samek | |
| 9,296,455 | B2 | 3/2016 | Bernloehr et al. | |
| 9,676,462 | B2 | 6/2017 | Bernloehr et al. | |
| 10,035,575 | B2 | 7/2018 | Bernloehr et al. | |
| 10,450,043 | B1 * | 10/2019 | Gyorog | B63H 20/007 |
| 11,046,408 | B1 * | 6/2021 | Crawford | B63H 20/12 |
| 2018/0244361 | A1 * | 8/2018 | Laster | B63H 20/007 |
| 2019/0093765 | A1 | 3/2019 | Kubota et al. | |
| 2019/0176953 | A1 | 6/2019 | Clark et al. | |
| 2019/0322340 | A1 | 10/2019 | Clark et al. | |

* cited by examiner

*Primary Examiner* — Stephen P Avila
(74) *Attorney, Agent, or Firm* — Nelson Mullins Riley & Scarborough LLP

(57) ABSTRACT

Trolling motor assemblies and related methods of operation. A method includes providing an assembly comprising a main housing; a shaft rotatably coupled with the main housing, the shaft having a longitudinal axis; a gear coupled with the shaft; a plate rotatably coupled with one of the shaft and the main housing; and a projecting rib coupled with the other of the shaft and the main housing. The plate is rotated through a first angular displacement about the longitudinal axis. The gear is rotated through a second angular displacement about the longitudinal axis that is greater than the first angular displacement.

20 Claims, 25 Drawing Sheets

SYSTEMS AND METHODS FOR ROTATIONAL CONTROL OF A TROLLING MOTOR

CROSS-REFERENCE TO RELATED APPLICATION(S)

This application is a continuation of U.S. patent application Ser. No. 16/795,661, entitled "Systems and Methods for Rotational Control of a Trolling Motor," filed Feb. 20, 2020, which is incorporated by reference herein in its entirety.

TECHNICAL FIELD

Embodiments of the present invention generally relate to the field of trolling motor assemblies for recreational vehicles, such as watercraft. More particularly, certain embodiments of the present invention relate to systems, assemblies, and associated methods for providing rotational control of a trolling motor assembly, such as by preventing over-rotation of components in a trolling motor assembly while also providing for angular displacement of such components greater than 360 degrees.

BACKGROUND

Trolling motors are often used during fishing or other marine activities and are mounted to recreational vehicles, such as watercraft, in a known manner. The trolling motors are mounted or attached to the watercraft and propel the watercraft along a body of water. For example, trolling motors may provide secondary propulsion or precision maneuvering that can be ideal for fishing activities. The trolling motors, however, may also be utilized for the main propulsion system of watercraft. Further, there are many helpful marine data features, such as navigation, sonar, motor/vessel gauges, among others, that can be used by operators or users of the watercraft with a trolling motor.

The foregoing discussion is intended only to illustrate various aspects of the related art in the field of the invention at the time, and should not be taken as a disavowal of claim scope.

SUMMARY

In some existing trolling motors, electronic components, such as a propulsion motor and/or sonar transducers, are disposed in a lower housing disposed at one end of a shaft. Wiring associated with these electronic components (e.g., power and communication wiring) may extend from the lower housing along the shaft (either internally or externally) to an upper housing disposed at the opposite end of the shaft. There, the wiring may connect to other electronic components, such as a processor and memory, or may extend to a power source, for example.

Trolling motors can be mechanically or electrically driven. In mechanically driven trolling motors (sometimes referred to as "cable-steer" motors), cables associated with a user-controlled foot pedal are mechanically linked to the propulsion motor. Very generally, pivoting of the foot pedal in such trolling motors pulls the cables, thereby causing the propulsion motor to rotate. "Hybrid" trolling motors are similar and may combine the use of cables with electrical features, such as power steering and autopilot. In trolling motors that employ cable steering, whether in whole or in part, the cables limit the total available rotation of the propulsion motor.

Electrically-driven trolling motors, however, do not have cables that are mechanically linked to the propulsion motor. Rather, in these trolling motors, a sensor in the foot pedal may determine the position of the foot pedal and provide that information to a processor in the upper housing of the trolling motor. The processor may use that information to cause the propulsion motor to rotate. In these types of trolling motors, the lower housing and shaft are typically free to rotate about the axis of the shaft through multiple revolutions, at least in the absence of another limit on rotation.

Over-rotation of electrically-driven trolling motors can damage the wiring that extends along the shaft and/or the electronic components to which the wiring is connected. As the lower housing and shaft rotate in a given direction about the shaft axis beyond one revolution, the wiring that is connected to components in the lower housing will become twisted. Depending on the amount of play or slack in the wiring, after one, two, or more full revolutions in a given direction, the wiring itself can become pinched or stretched, or it could break or at least separate from the electronic components to which it is connected, causing the trolling motor to become inoperative. Over-rotation may occur, for example, when a user manually turns the trolling motor when the motor is not operating (e.g., during installation, maintenance, a power failure event, or storage) or it may occur during normal use in response to a user's actuation of a control mechanism (such as a foot pedal).

Although it is possible to limit the trolling motor's rotation to a maximum of 360 degrees via mechanical means, consumers typically expect that trolling motors will be rotatable through an angle greater than 360 degrees. This is because users may experience limitations on maneuverability if rotation is limited to a maximum of 360 degrees. For instance, if a user driving a watercraft with the propulsion motor oriented at an angle of 0 degrees were to reverse course and turn the motor in a given direction to 180 degrees, the motor may encounter a limit on its rotation. The user would find his maneuverability similarly limited, in that the user could not continue turning the motor in the same direction beyond 180 degrees, and thus may not be able to steer with the motor in this position. To steer the watercraft to 185 degrees, for example, the user would have to turn the motor almost a full revolution back around in an opposite direction.

Existing trolling motors are not able to provide greater than 360 degrees of rotation of a propulsion motor while also sufficiently preventing the problem of over-rotation. Some trolling motors have rotational limits programmed into software associated with the motor's controller. For example, software may be programmed to limit the motor's rotation to a predetermined angular rotation. However, such software cannot prevent over-rotation that may occur when the trolling motor is off, or that may occur as a result of a software bug or malfunction. The software may also not be able to determine the angular position of the propulsion motor once power is reapplied, because the software cannot track the motor's rotation when power is off.

In theory, certain gear configurations might be used to mechanically prevent over-rotation (i.e., without regard to software) while also allowing rotation beyond 360 degrees. Nonetheless, it is believed that such configurations would be impractical and cost-prohibitive, in that, for example, their components require more space to implement.

According to one embodiment of the present invention, a trolling motor assembly comprises a main housing and a shaft rotatably coupled with the main housing. The main housing defines a rib on an interior surface thereof, and the shaft has a longitudinal axis. The trolling motor assembly also comprises a gear assembly disposed within the main housing. The gear assembly comprises a gear coupled with the shaft and a plate rotatably coupled with the gear. The plate comprises a tab having a first lateral face and a second lateral face. The gear, plate, and shaft are rotatable about the shaft longitudinal axis. The plate is rotatable through a first angular displacement about the longitudinal axis between a first angular position, at which the first lateral face of the tab engages the rib defined on the interior surface of the main housing, and a second angular position at which the second lateral face engages the rib. The gear is rotatable through a second angular displacement about the longitudinal axis that is greater than the first angular displacement.

In some embodiments, a trolling motor housing is coupled with the shaft and has a propulsion motor disposed therein. In various embodiments, a collar may be disposed on the shaft, wherein the gear is in mating engagement with the collar. In some embodiments, the plate defines at least one aperture and wherein the plate is coupled with the gear by at least one fastener extending through the at least one aperture. Additionally, in various embodiments, a motor is disposed within the main housing, and the motor is operative to cause rotational movement of the gear. In some embodiments, the first angular displacement is less than 360 degrees. In some specific embodiments, the first angular displacement is about 354 degrees. In some embodiments, the second angular displacement is greater than 360 degrees. In some specific embodiments, the second angular displacement is about 460 degrees. In various embodiments, the trolling motor assembly further comprises a processor in electronic communication with a motor that is operative to cause rotation of the gear, and a non-transitory memory has instructions stored thereon, wherein the instructions, when executed by the processor, operate the motor to limit rotation of the gear through a third angular displacement, wherein the third angular displacement is about 400 degrees.

According to yet another embodiment of the present invention, provided is a method of operating a trolling motor assembly. The method comprises providing a main housing, a trolling motor housing, and a shaft extending between the main housing and the trolling motor housing, the shaft having a longitudinal axis. A gear assembly is disposed within the main housing, and the gear assembly comprises a gear coupled for rotational movement with the shaft and a plate coupled with the gear. The method also comprises rotating the gear assembly and shaft relative to the main housing in a first direction about the shaft longitudinal axis from a first angular position to a second angular position, wherein at the second angular position the plate engages a portion of the main housing and the plate is restrained from further rotational movement in the first direction. The method additionally comprises further rotating the gear and shaft relative to the plate and to the main housing in the first direction about the shaft longitudinal axis from the second angular position to a third angular position.

In various embodiments, the plate is disposed beneath the gear. In some embodiments, the method further comprises rotating the gear and shaft relative to the plate and to the main housing in the first direction about the shaft longitudinal axis from the third angular position to a fourth angular position, wherein at the fourth angular position the gear is restrained from further rotational movement relative to the plate. In some embodiments, the plate defines a pair of curved slots and wherein the plate is coupled to the gear via a fastener extending through each curved slot. In various embodiments, each curved slot extends through an angle of about 100 degrees. In some embodiments, the angle between the second angular position and the fourth angular position is less than about 100 degrees.

According to a further embodiment of the present invention, a method of operating a trolling motor assembly is provided. The method comprises providing an assembly comprising a main housing; a shaft rotatably coupled with the main housing, the shaft having a longitudinal axis; a gear coupled with the shaft; a plate rotatably coupled with one of the shaft and the main housing; and a projecting rib coupled with the other of the shaft and the main housing. The method also comprises rotating the plate through a first angular displacement about the longitudinal axis. Further, the method comprises rotating the gear through a second angular displacement about the longitudinal axis that is greater than the first angular displacement.

In some embodiments, the projecting rib is rotatably coupled with the main housing and the plate is rotatably coupled with the shaft, and the plate comprises a projecting tab. In some embodiments, the method further comprises rotating the shaft and plate in a first direction about the longitudinal axis from a first angular position to a second angular position, and rotating the shaft relative to the plate in the first direction from the second angular position to a third angular position. In various embodiments, the projecting rib of the main housing interferes with the projecting tab of the plate at the second angular position to prevent rotation of the plate in the first direction from the second angular position to the third angular position.

According to yet another embodiment of the present invention, a method of operating a trolling motor assembly is provided. The method comprises providing an assembly, comprising: a main housing; a trolling motor housing; a shaft extending between the main housing and the trolling motor housing, the shaft having a longitudinal axis; a motor disposed in the main housing; a gear assembly disposed in the main housing and operatively connected with the motor; and a processor disposed in the main housing and in electronic communication with the motor. The method also comprises receiving, at the processor, information representative of an angular position of the trolling motor housing. Further, the method comprises rotating the gear assembly and the shaft relative to the main housing in a first direction of rotation about the shaft longitudinal axis. Also, the method comprises determining whether a limit on rotation of the gear assembly and shaft relative to the main housing in the first direction of rotation has been reached. The method additional comprises rotating the gear assembly and shaft relative to the main housing in a second direction of rotation opposite the first direction of rotation about the shaft longitudinal axis.

In some embodiments, the method further comprises determining whether the gear assembly and shaft are at the angular position. In various embodiments, the method comprises updating information regarding the angular position of the gear assembly and shaft if it is determined that the limit on rotation of the gear assembly and shaft relative to the main housing in the first direction of rotation has been reached. In some embodiments, the method also comprises determining whether a predetermined angular displacement of the gear assembly and shaft has occurred. In some embodiments, the method comprises updating information regarding the angular position of the gear assembly and shaft. Further, in various embodiments, the method comprises continuing to rotate the gear assembly and shaft relative to the main housing in the first direction of rotation about the shaft longitudinal axis until the gear assembly and shaft are at the angular position. In various embodiments, the limit on rotation comprises a rib projecting from the main housing.

BRIEF DESCRIPTION OF THE DRAWINGS

Figure 1:
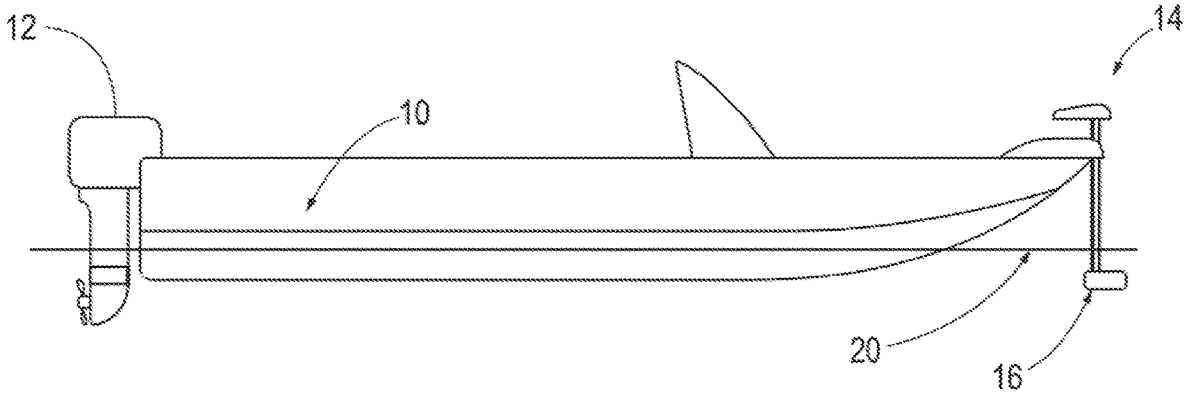
Figure 2:
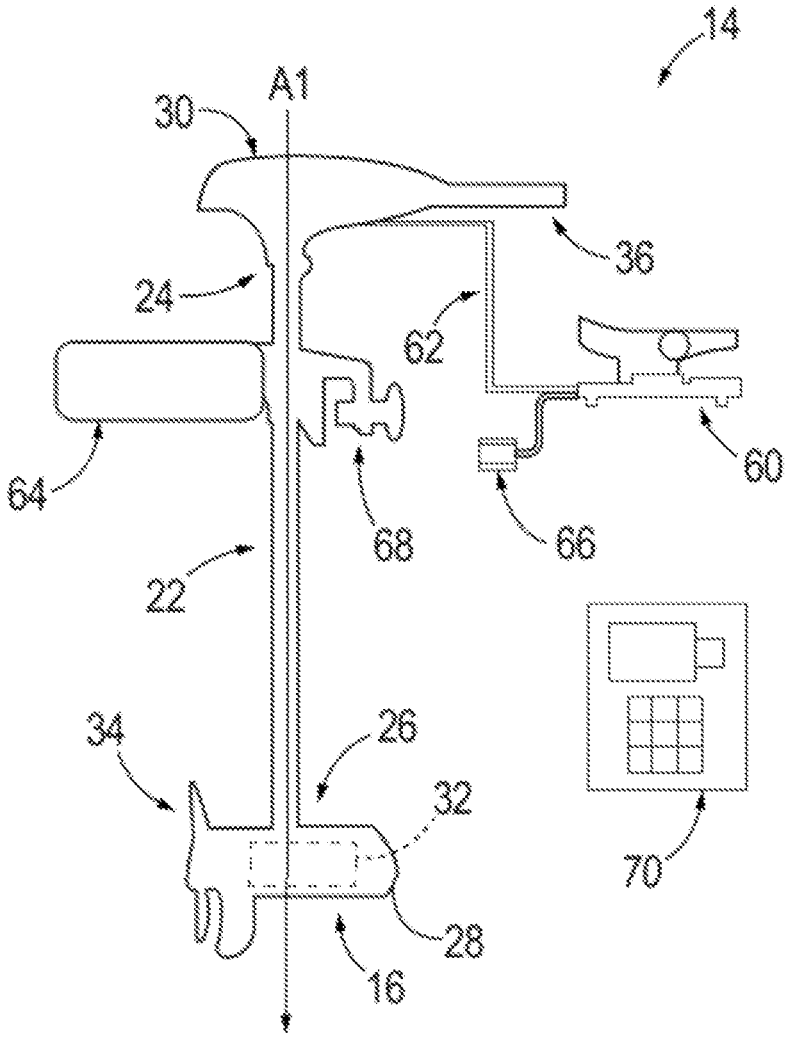
Figure 3:
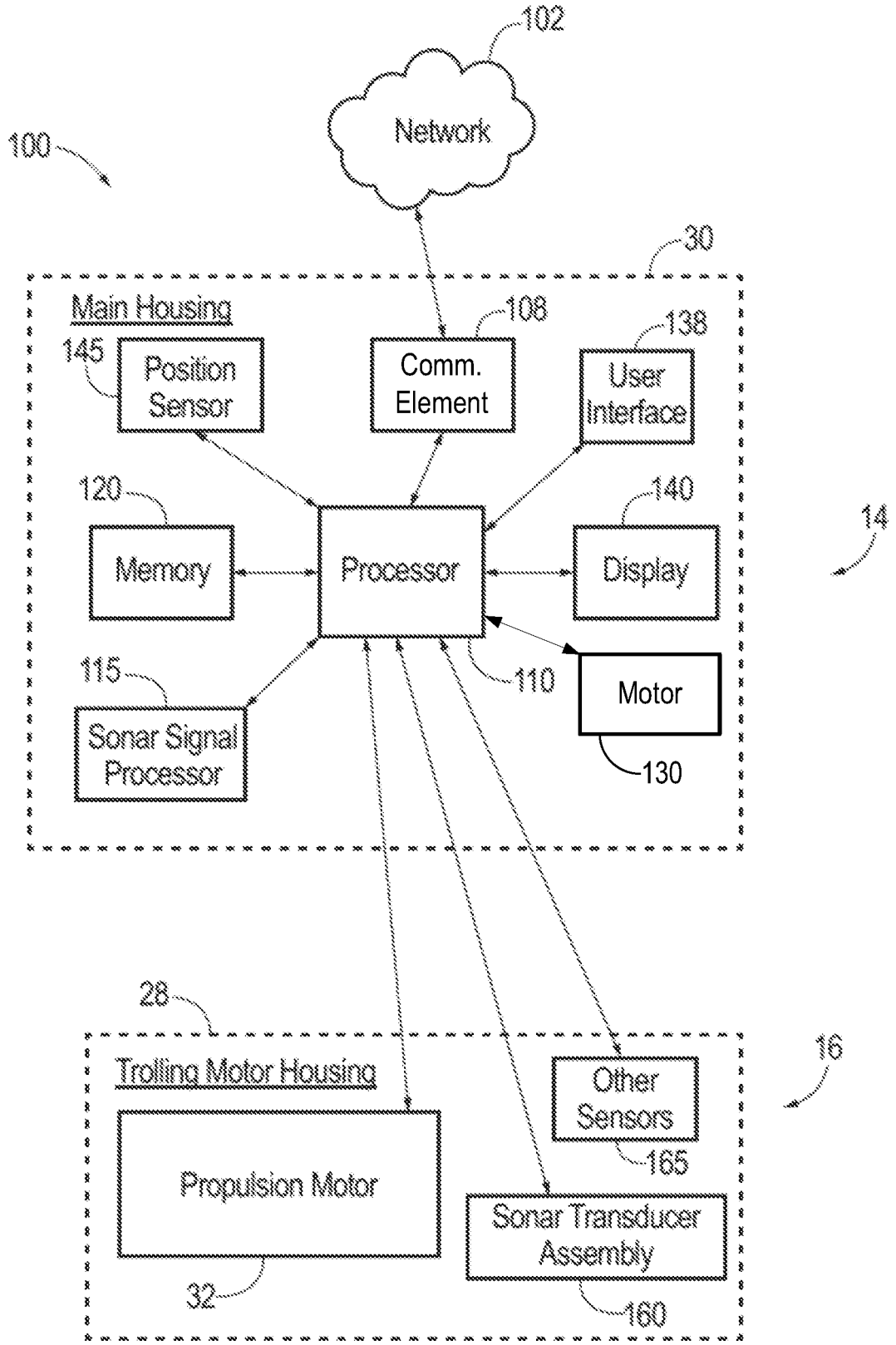
Figure 4A:
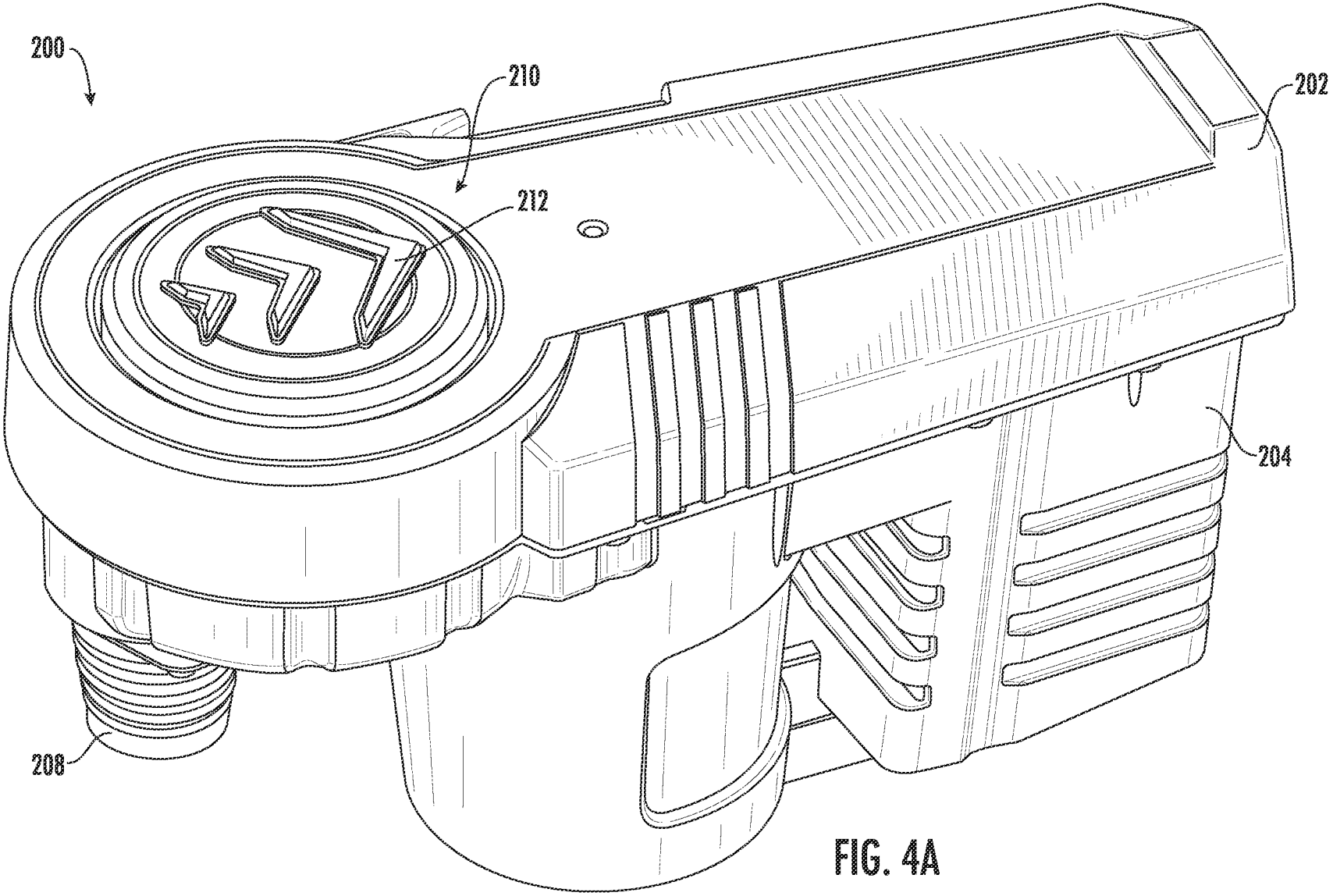
Figure 4B:
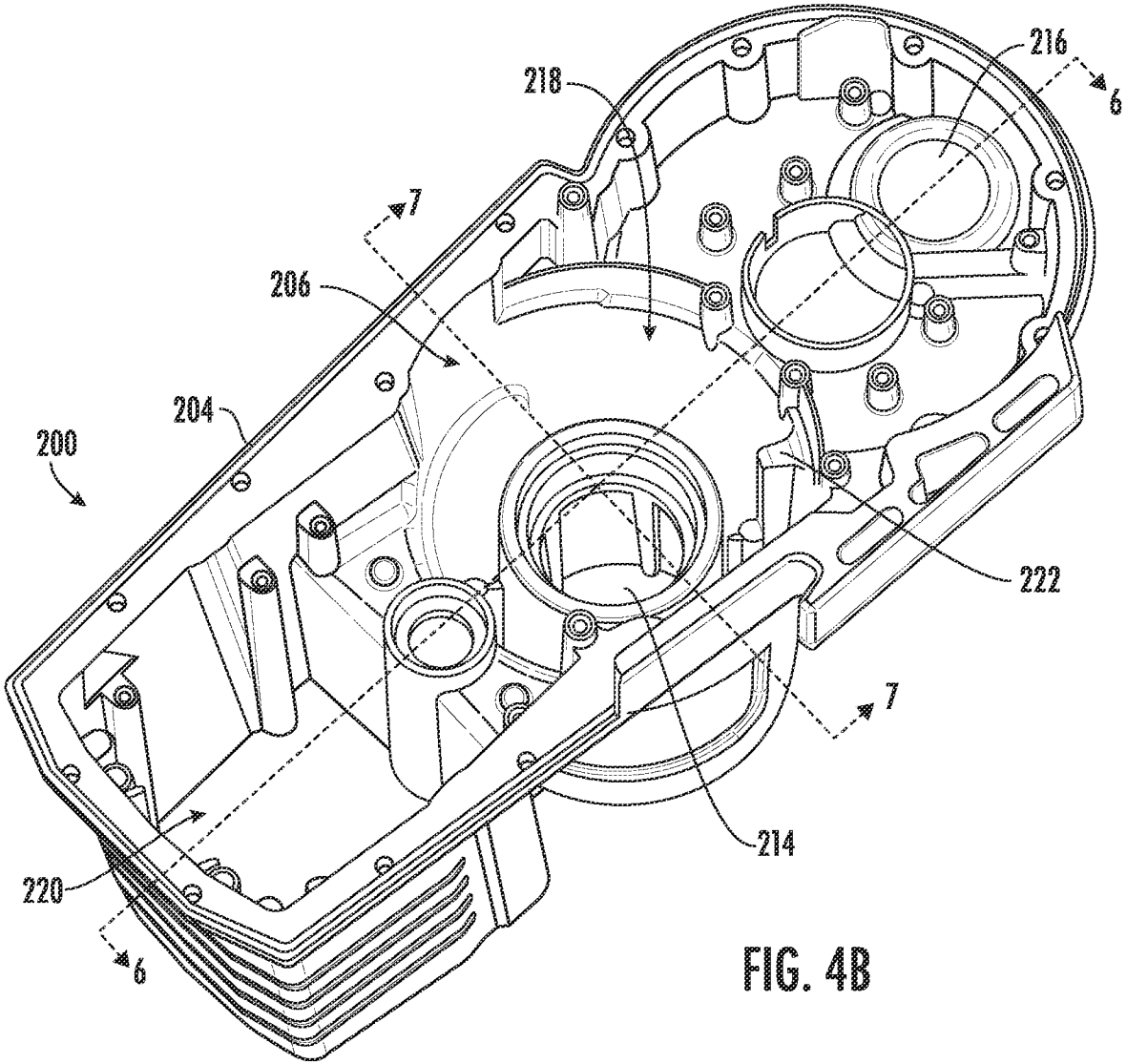
Figure 5:
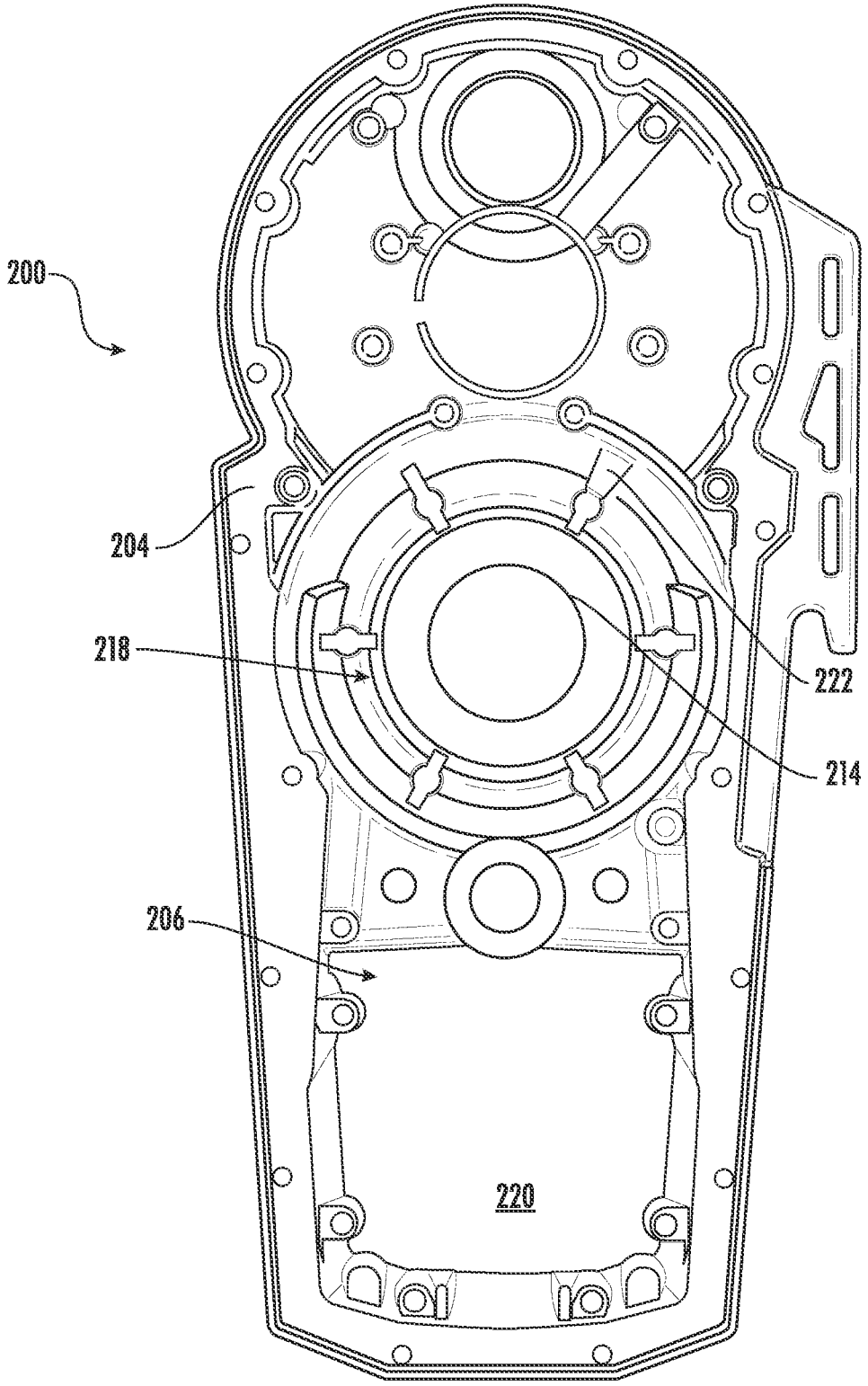
Figure 6:
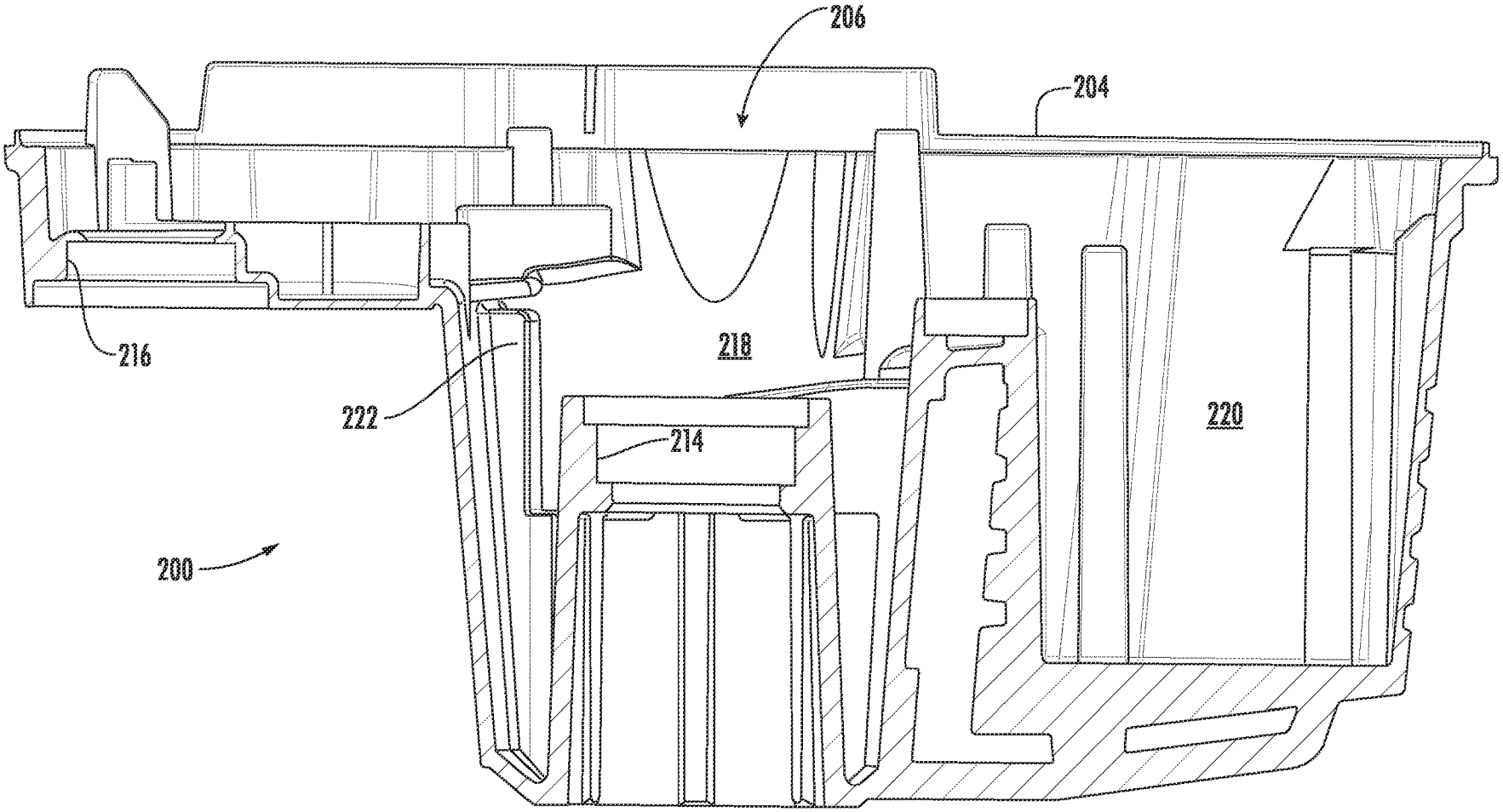
Figure 7:
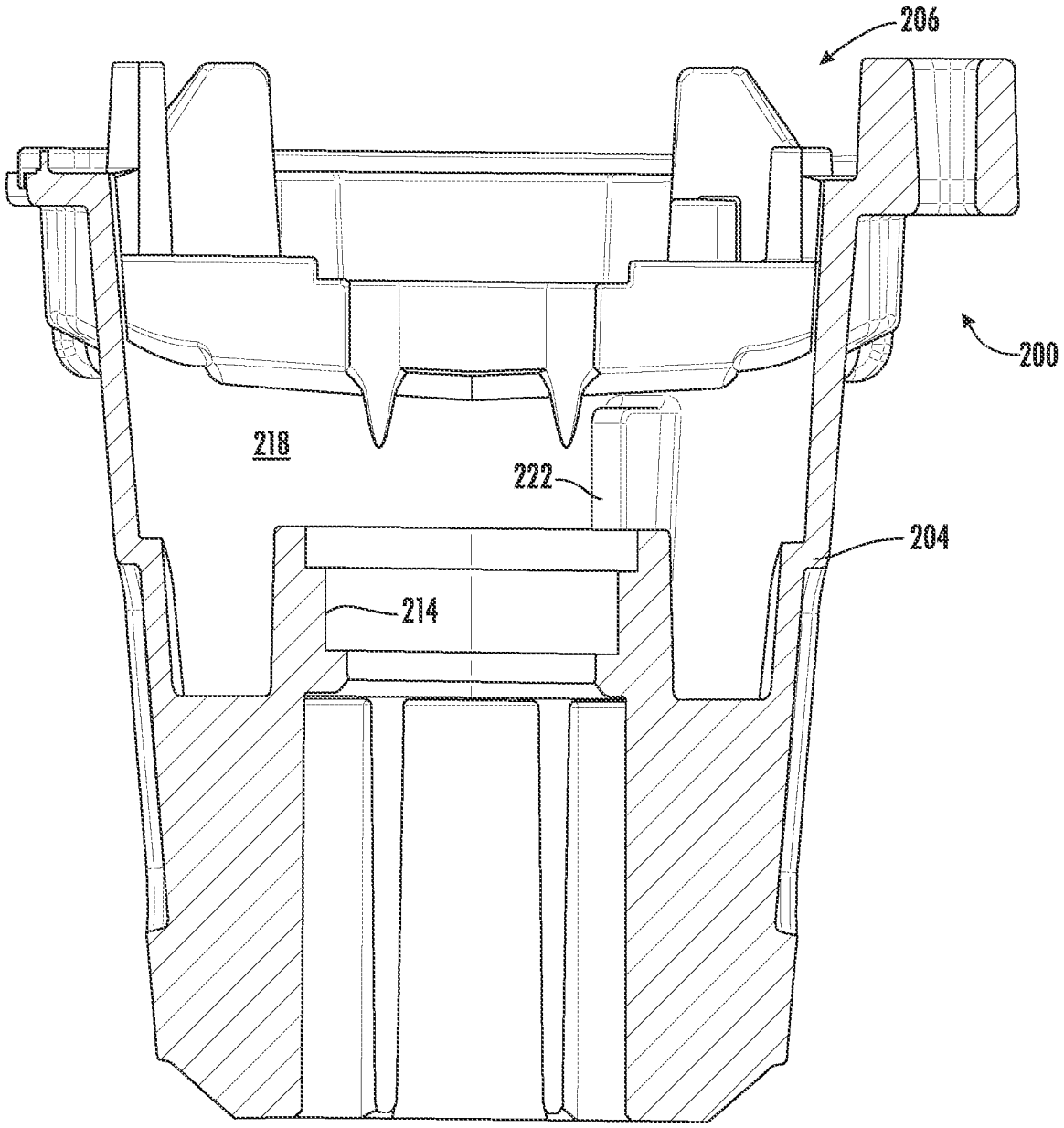
Figure 8:
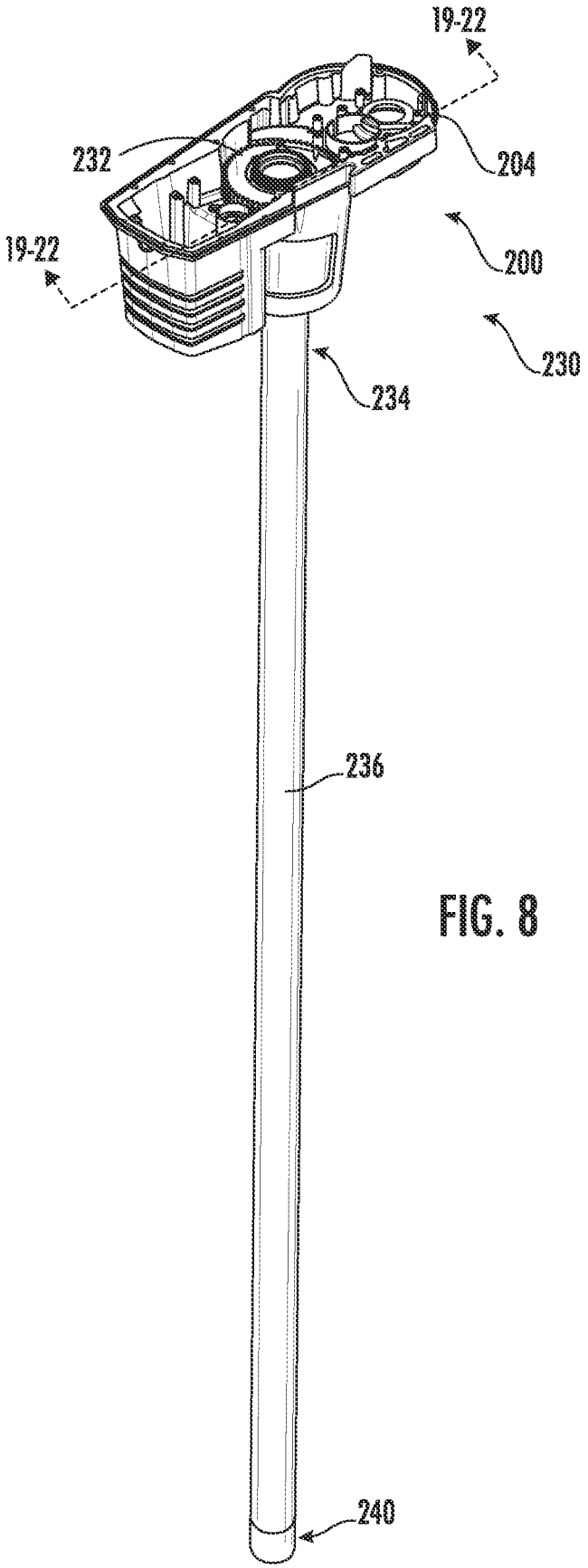
Figure 9:
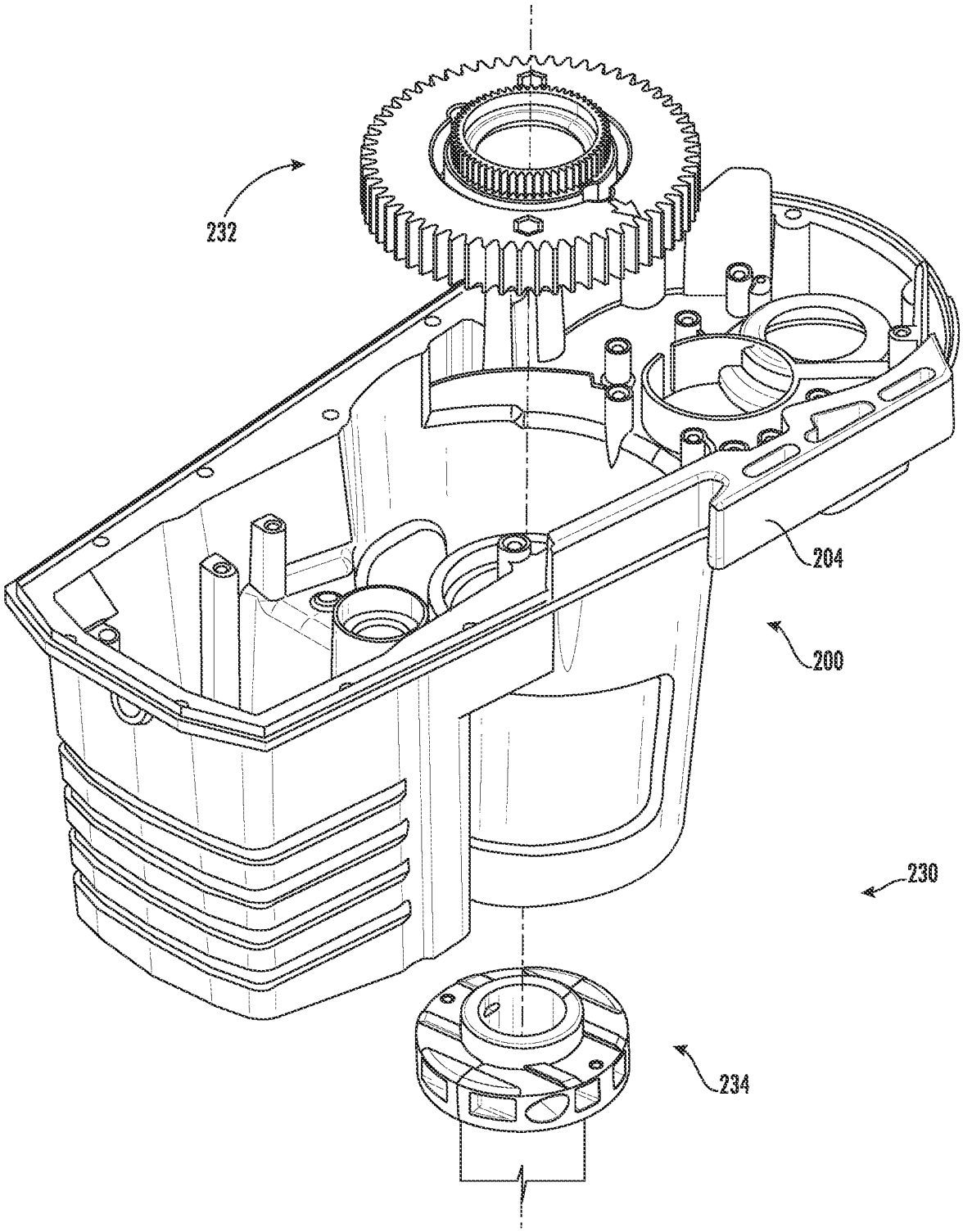
Figure 10:
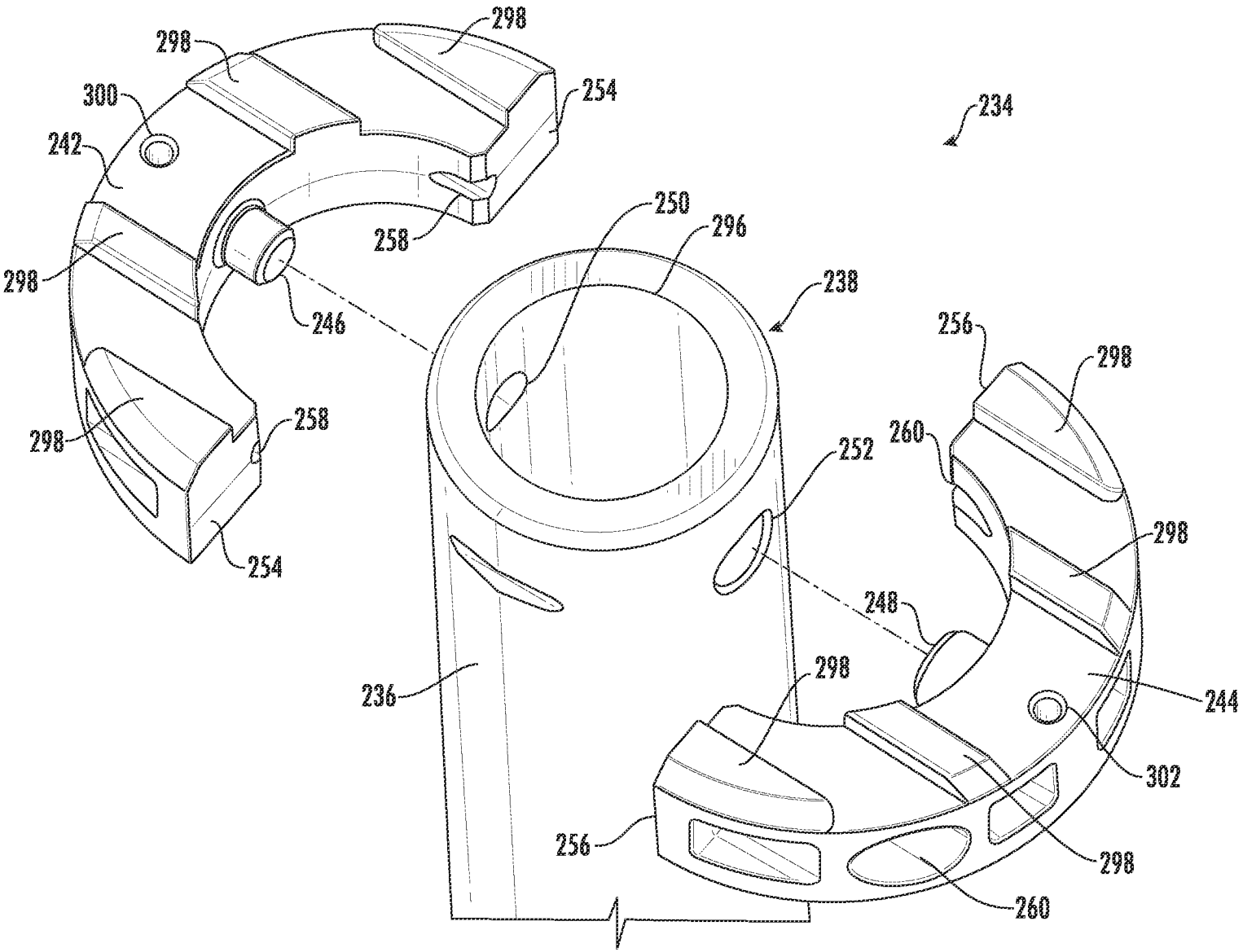
Figure 11:
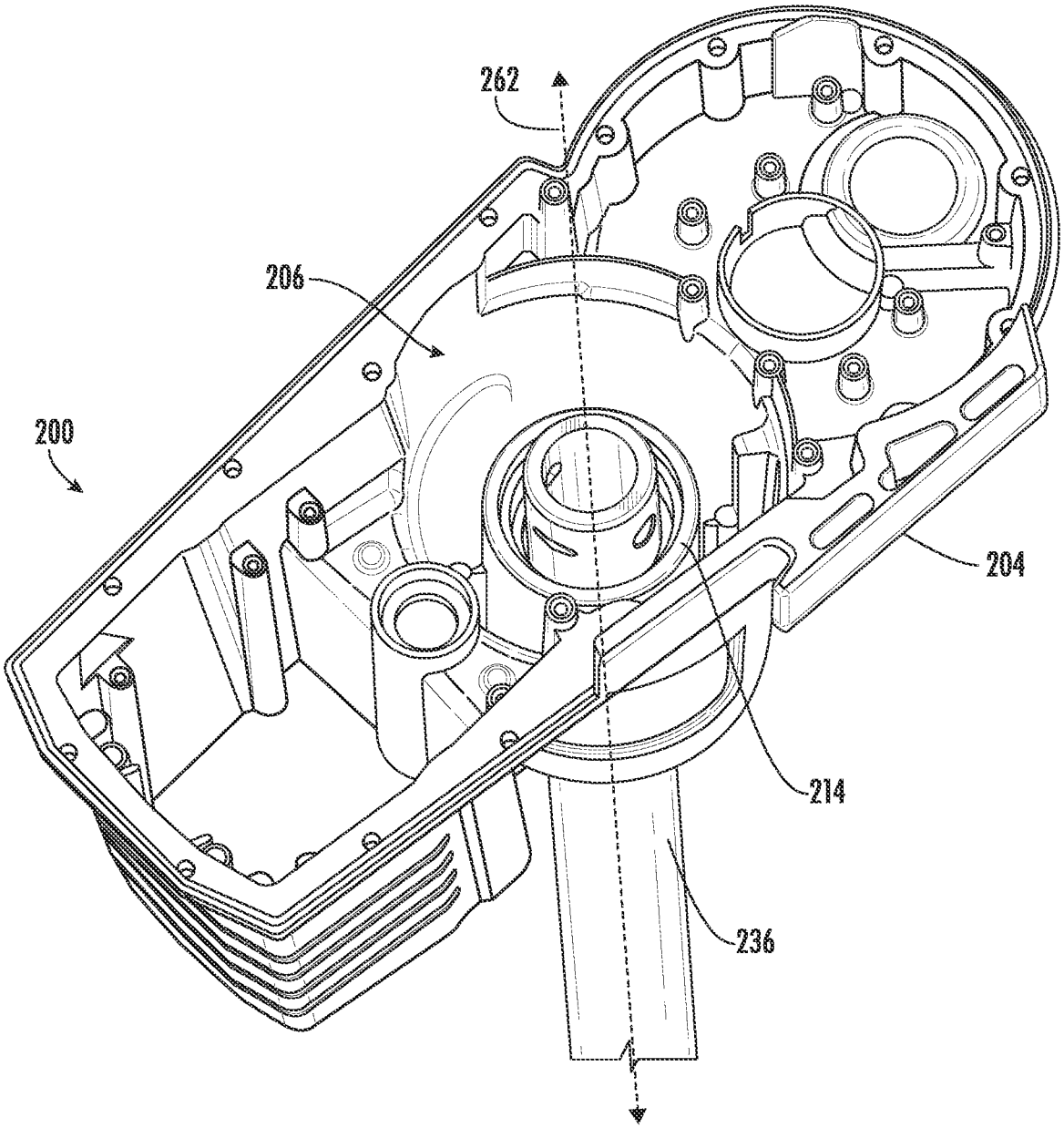
Figure 12:
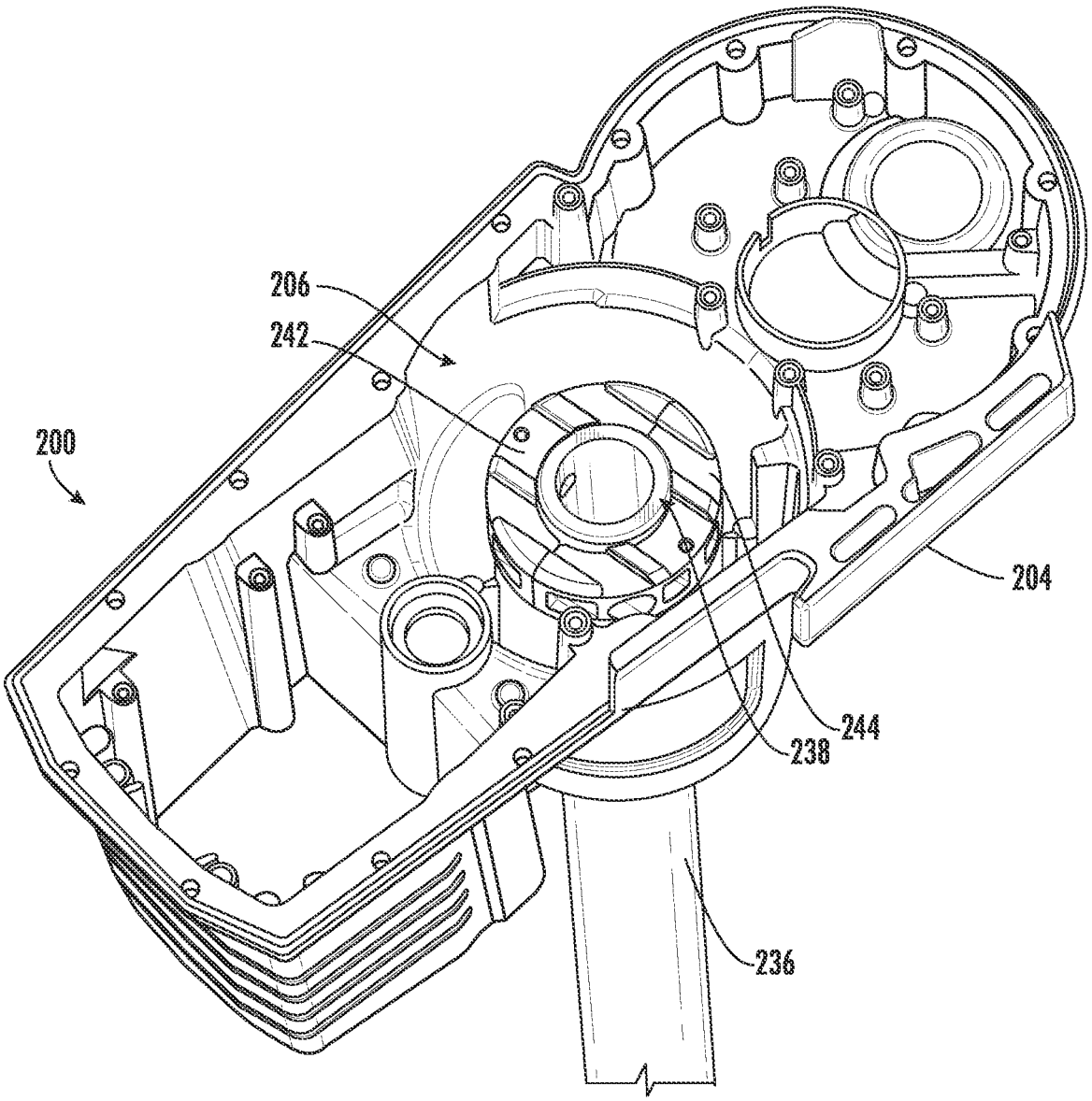
Figure 13:
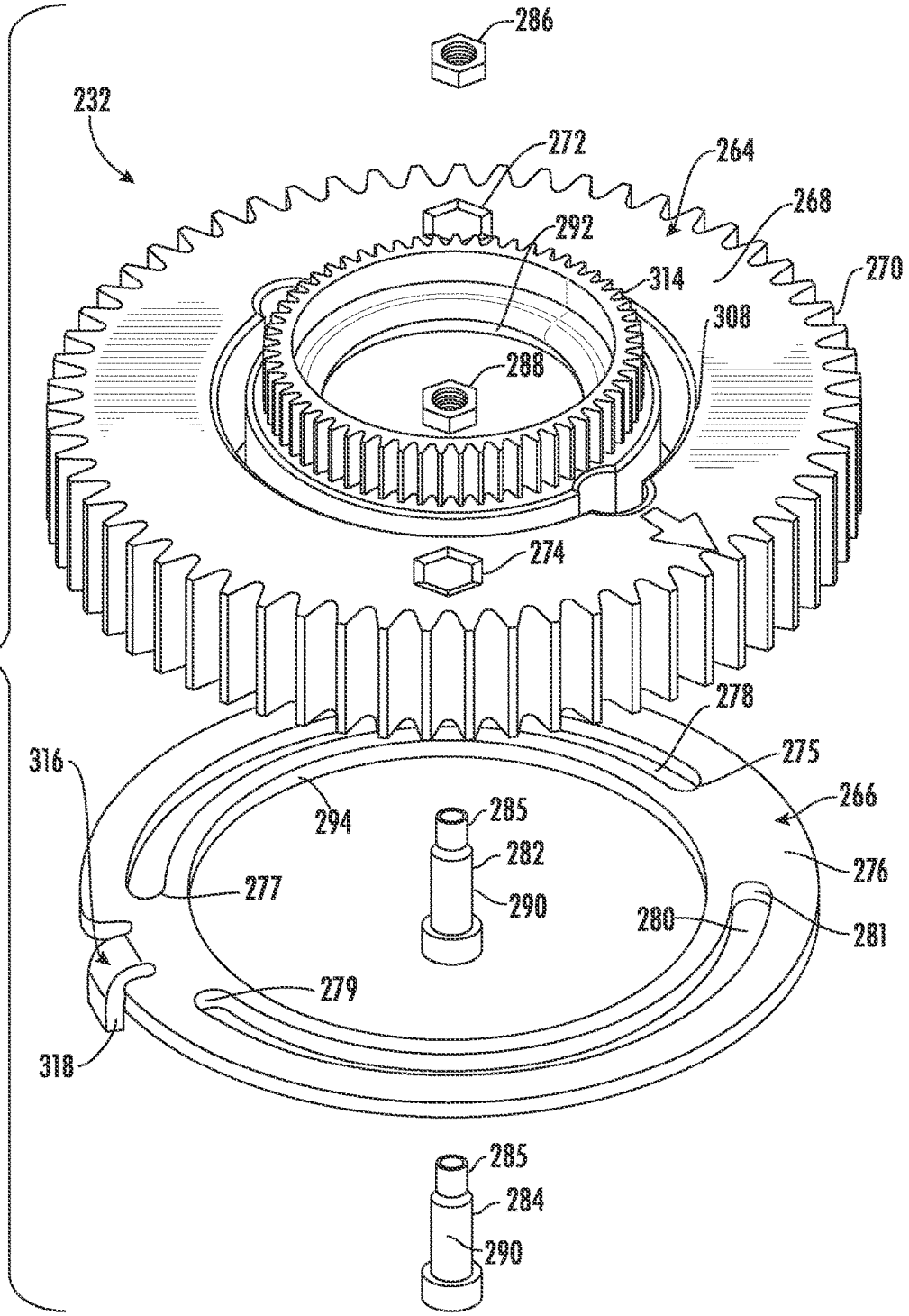

Having thus described some example embodiments in general terms, reference will now be made to the accompanying drawings, which are not necessarily drawn to scale, and wherein:

FIG. 1 is a side elevation view of a watercraft having a trolling motor assembly coupled to a front portion thereof in accordance with an embodiment of the present invention;

FIG. 2 is a schematic representation of a trolling motor assembly with which embodiments of the present invention may be used;

FIG. 3 is a block diagram of an example trolling motor assembly with which embodiments of the present invention may be used;

FIG. 4A is a perspective view of a main housing of a trolling motor assembly in accordance with an embodiment of the present invention;

FIG. 4B is a perspective view of the main housing of FIG. 4A with a portion of the main housing removed;

FIG. 5 is a top side plan view of the main housing of FIG. 4B;

FIG. 6 is a cross-sectional view taken along the line 6-6 in FIG. 4B;

FIG. 7 is a cross-sectional view taken along the line 7-7 in FIG. 4B;

FIG. 8 is a perspective view of a gear assembly coupled with a shaft assembly and disposed within the main housing of FIG. 4B in accordance with an embodiment of the present invention;

FIG. 9 is an enlarged, partially exploded view of the gear assembly, shaft assembly, and main housing of FIG. 8;

FIG. 10 is an enlarged, exploded view of a shaft assembly in accordance with an embodiment of the present invention;

FIG. 11 is a perspective view of the main housing of FIG. 4B disposed over a proximal end of the shaft of the shaft assembly of FIG. 10 in accordance with an embodiment of the present invention;

FIG. 12 is a perspective view of the main housing of FIG. 4B coupled with the shaft assembly of FIG. 10 in accordance with an embodiment of the present invention;

FIG. 13 is an exploded view of a gear assembly in accordance with an embodiment of the present invention.

Figure 14:
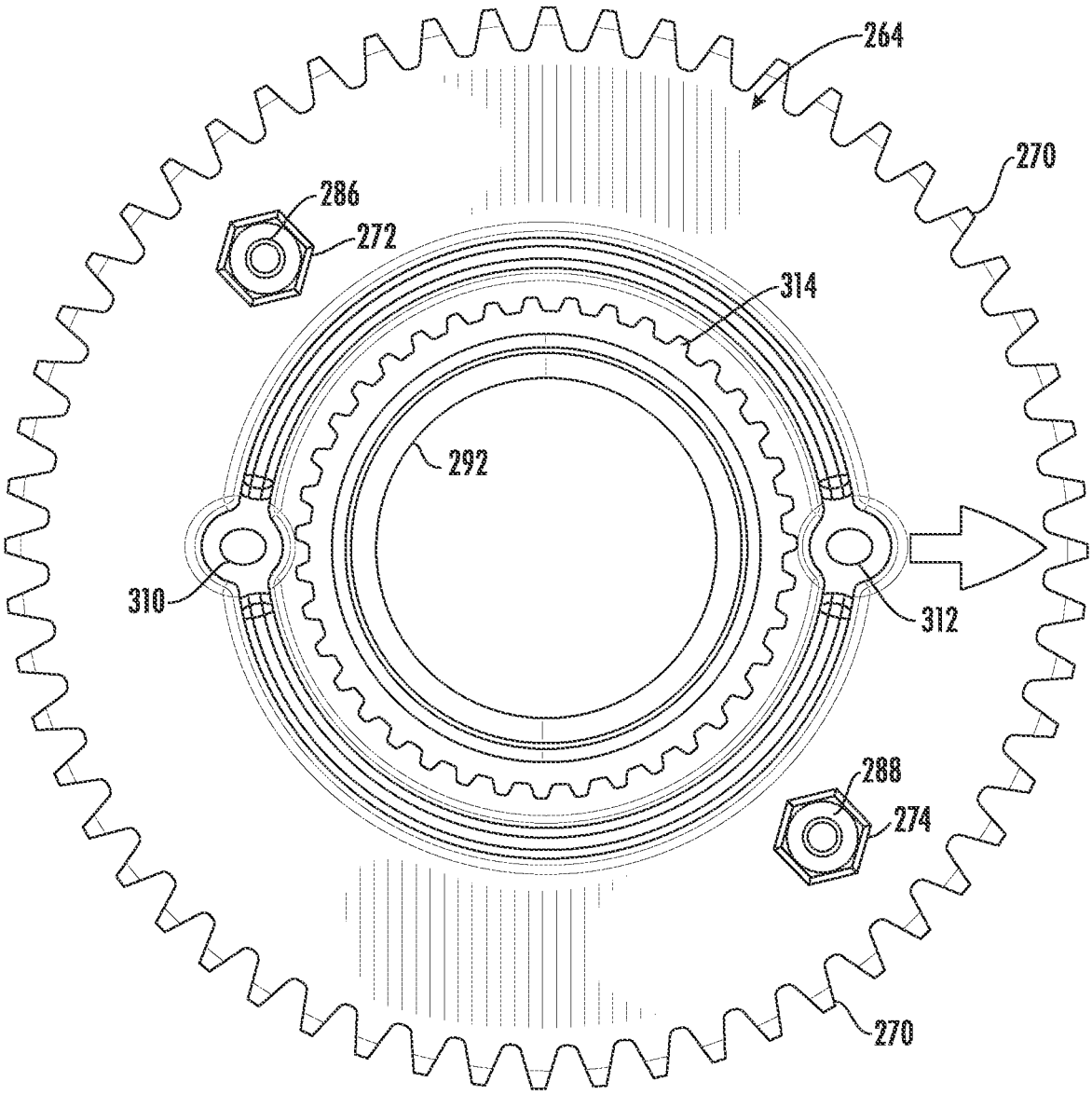
Figure 15:
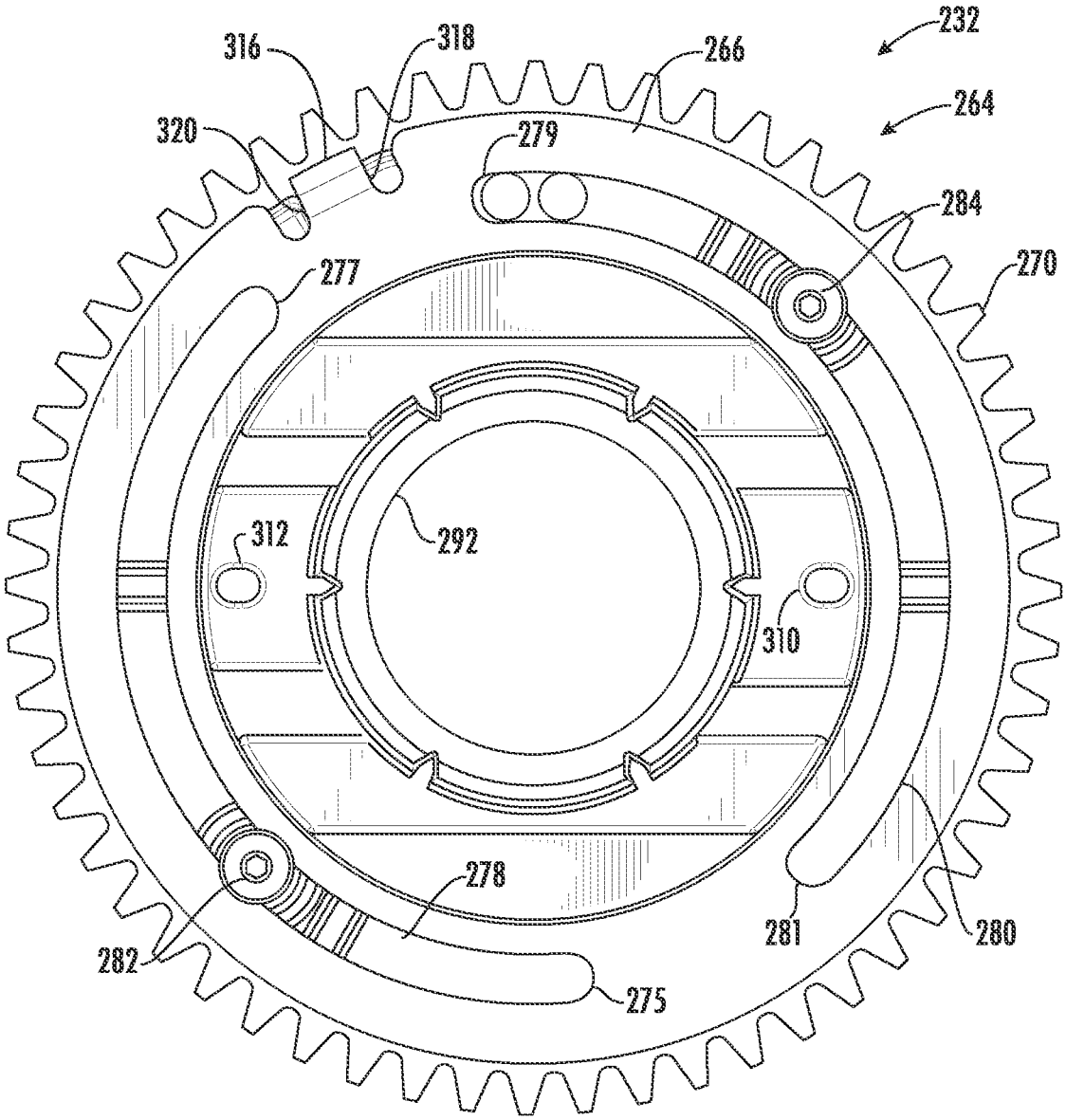
Figure 16:
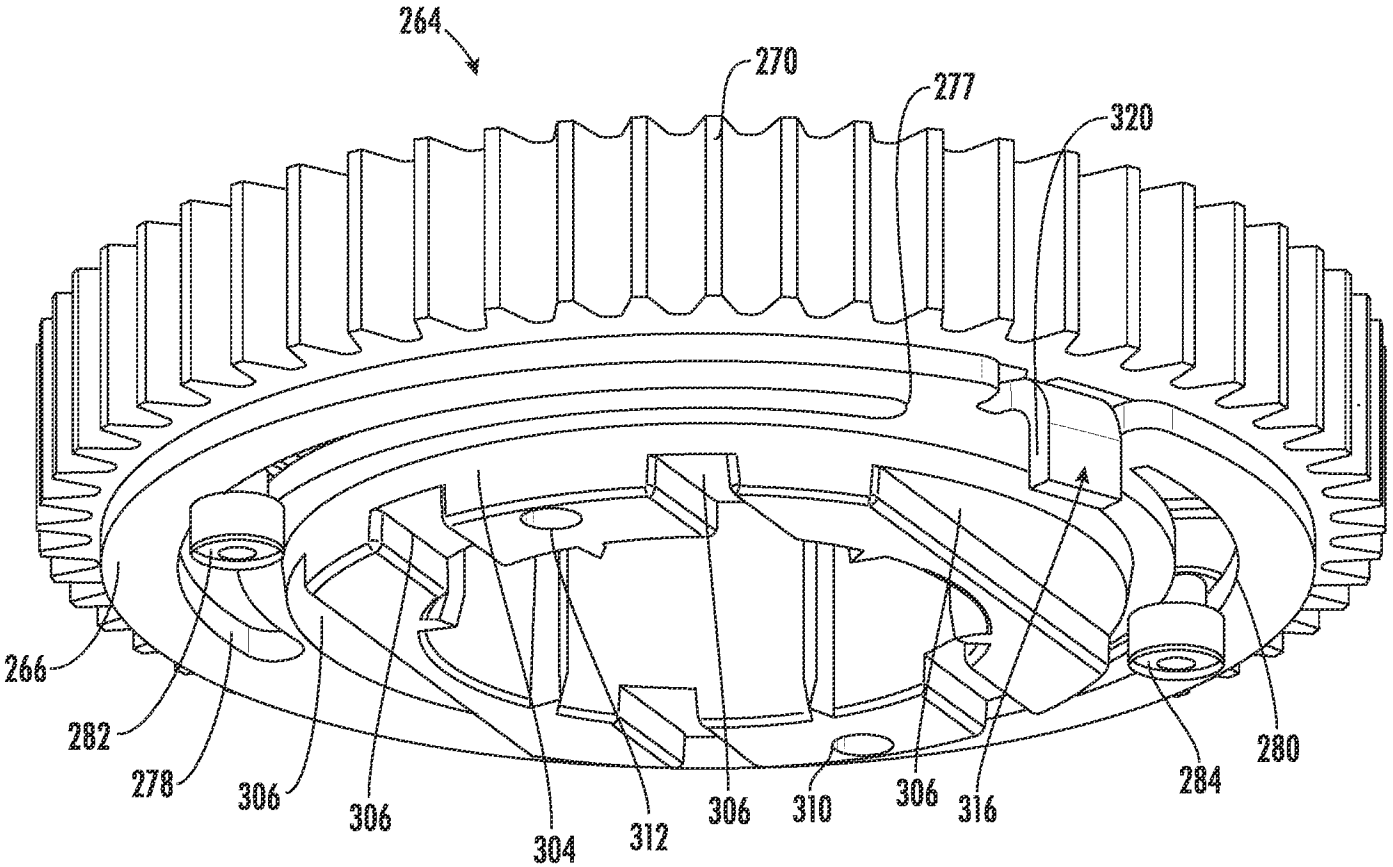
Figure 17:
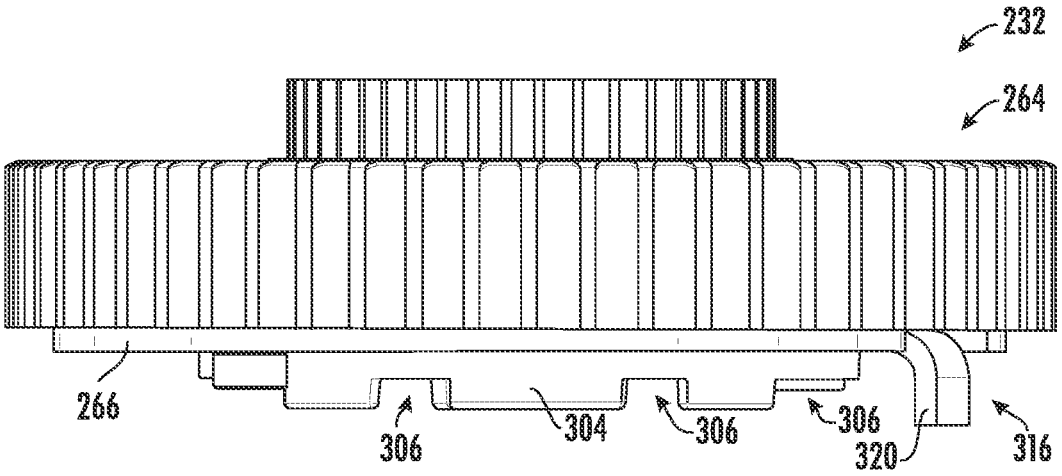
Figure 18:
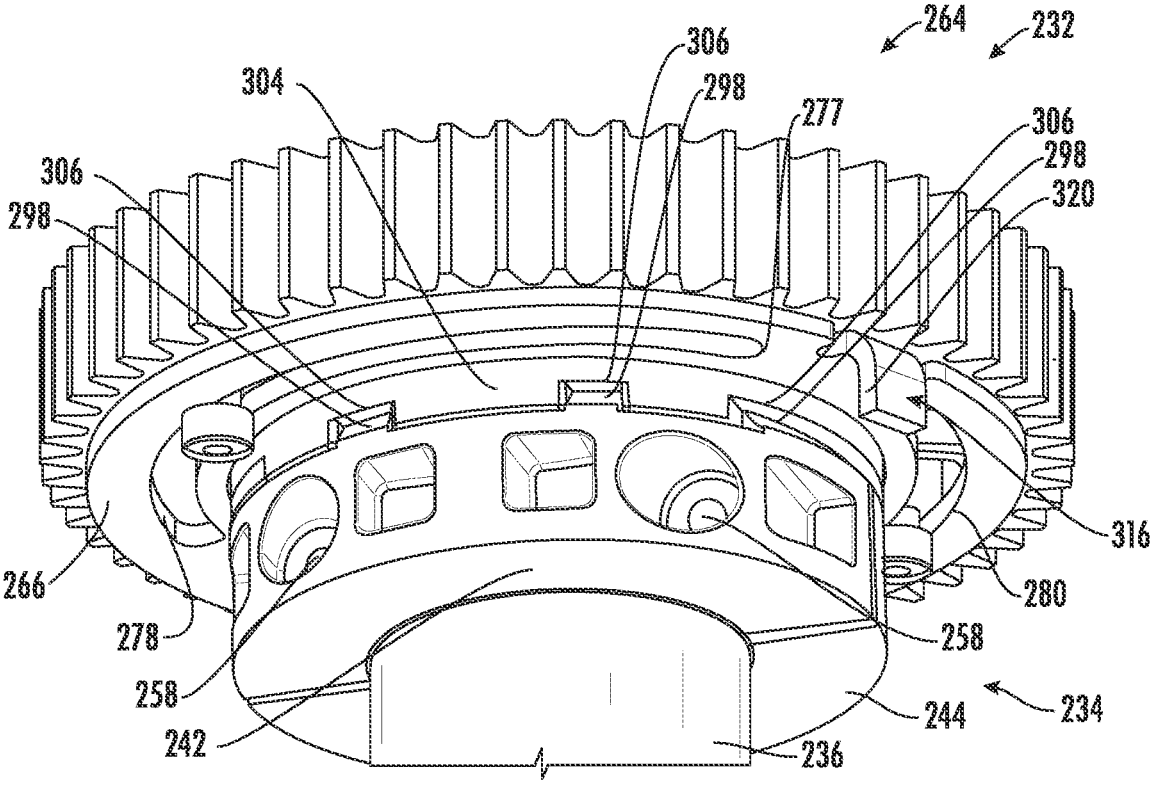
Figure 19:
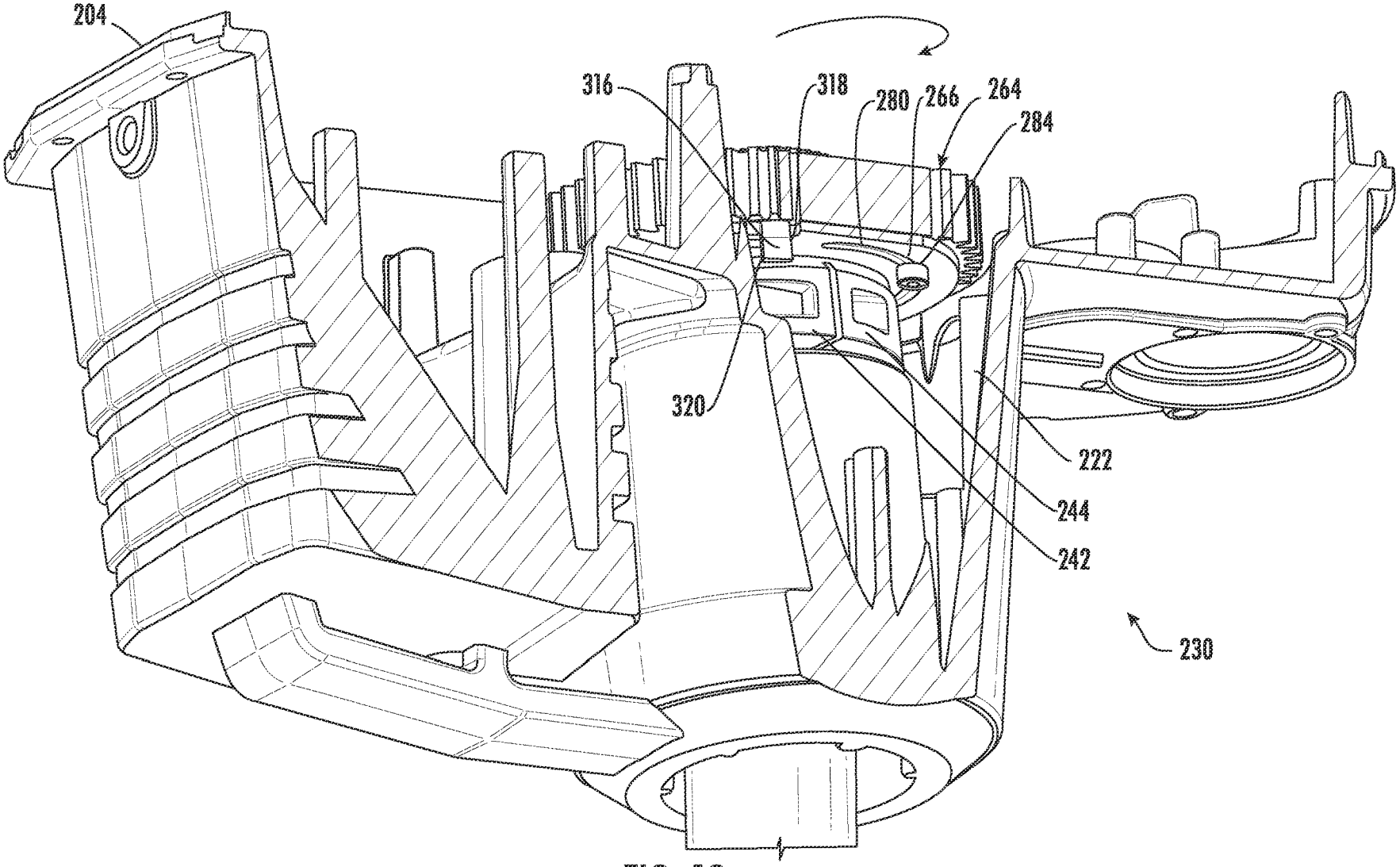
Figure 20:
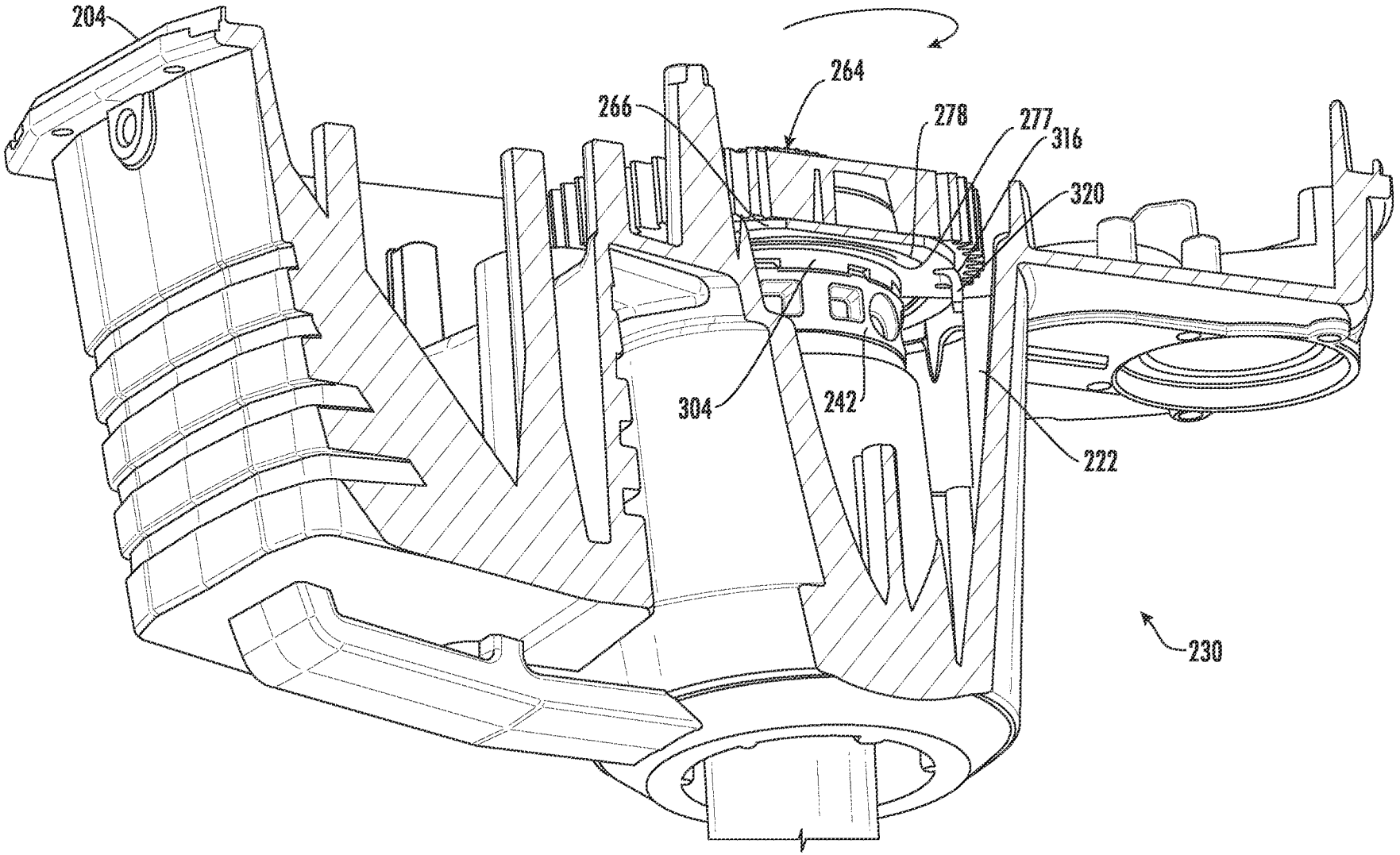
Figure 21:
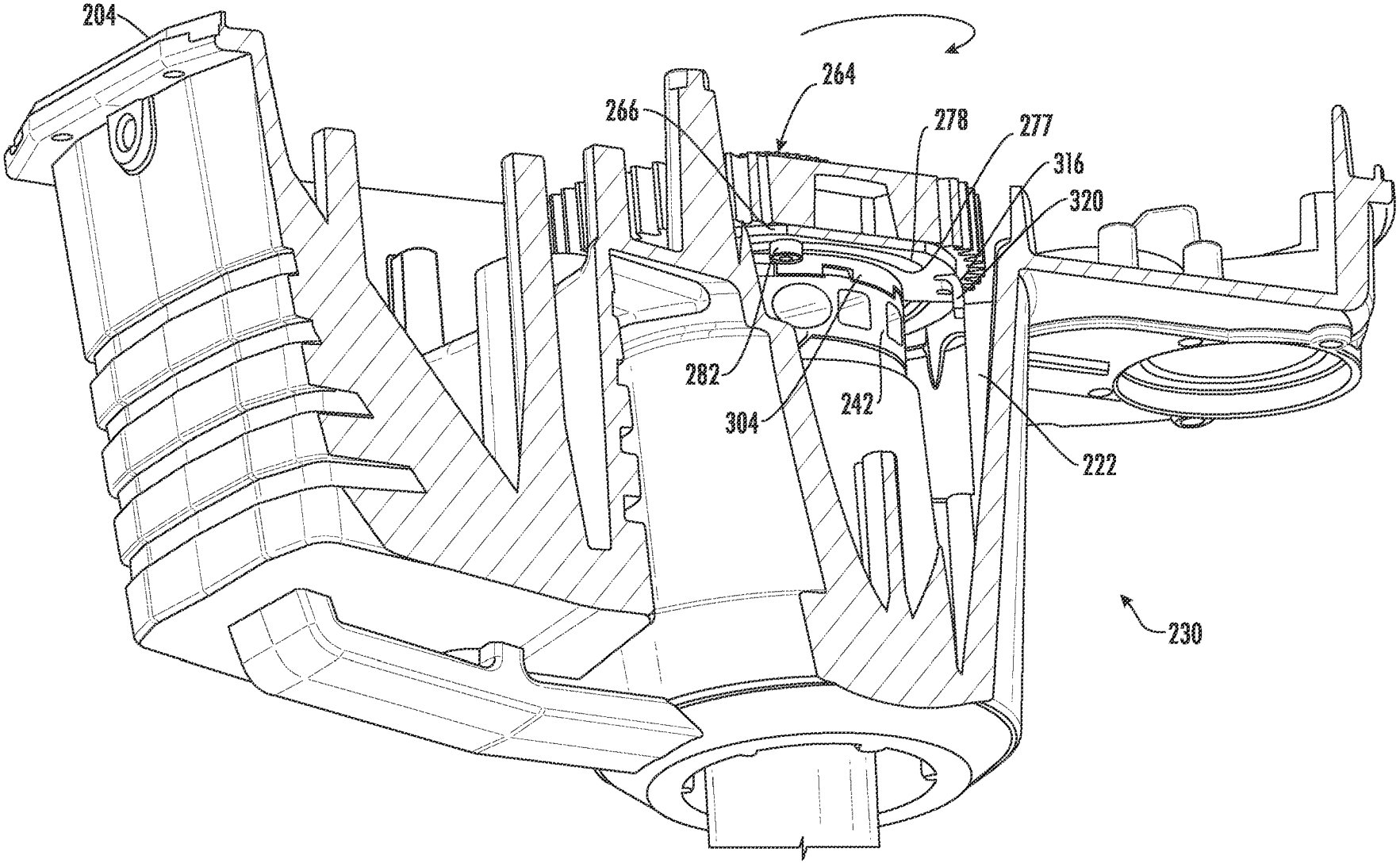
Figure 22:
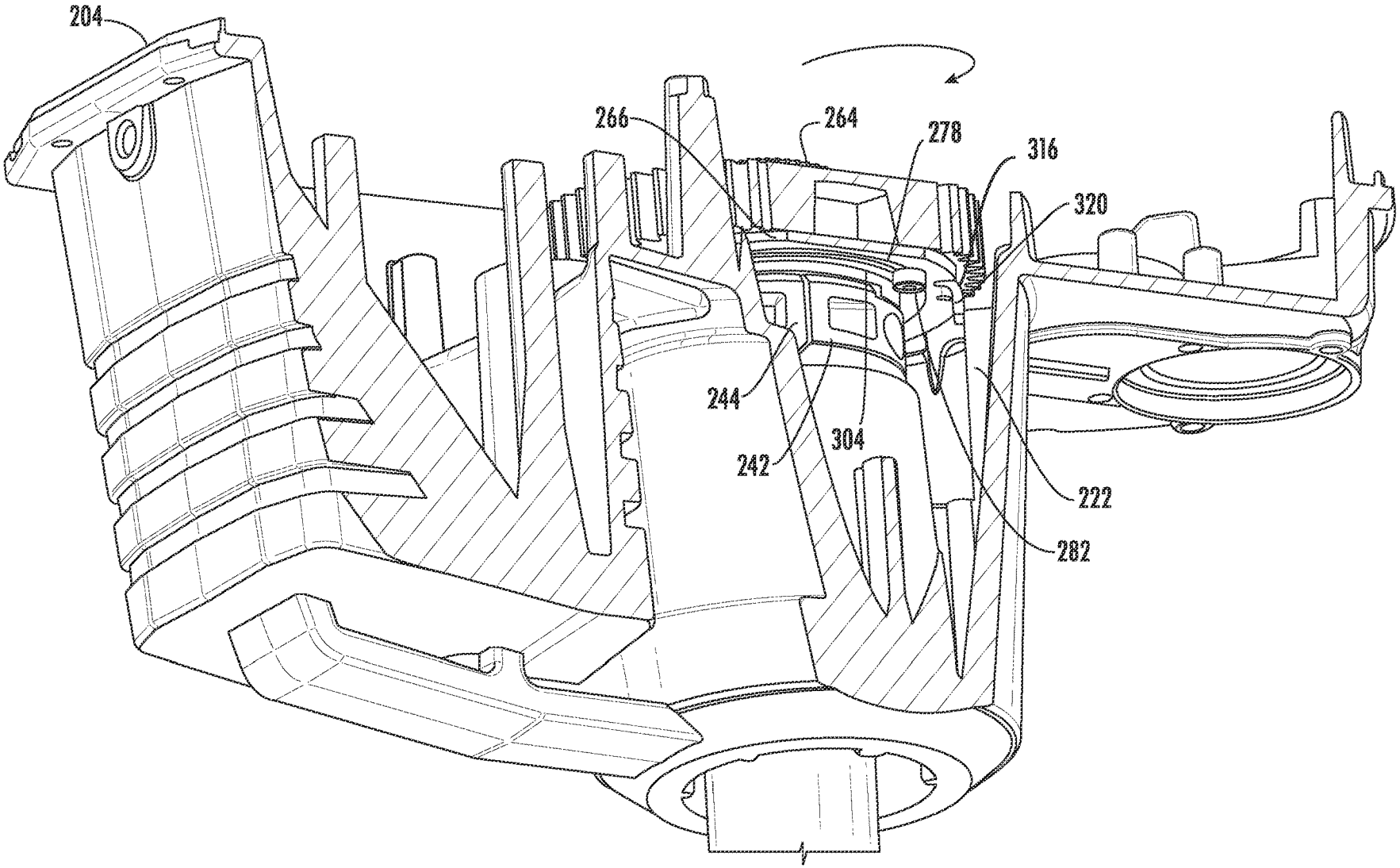
Figure 23:
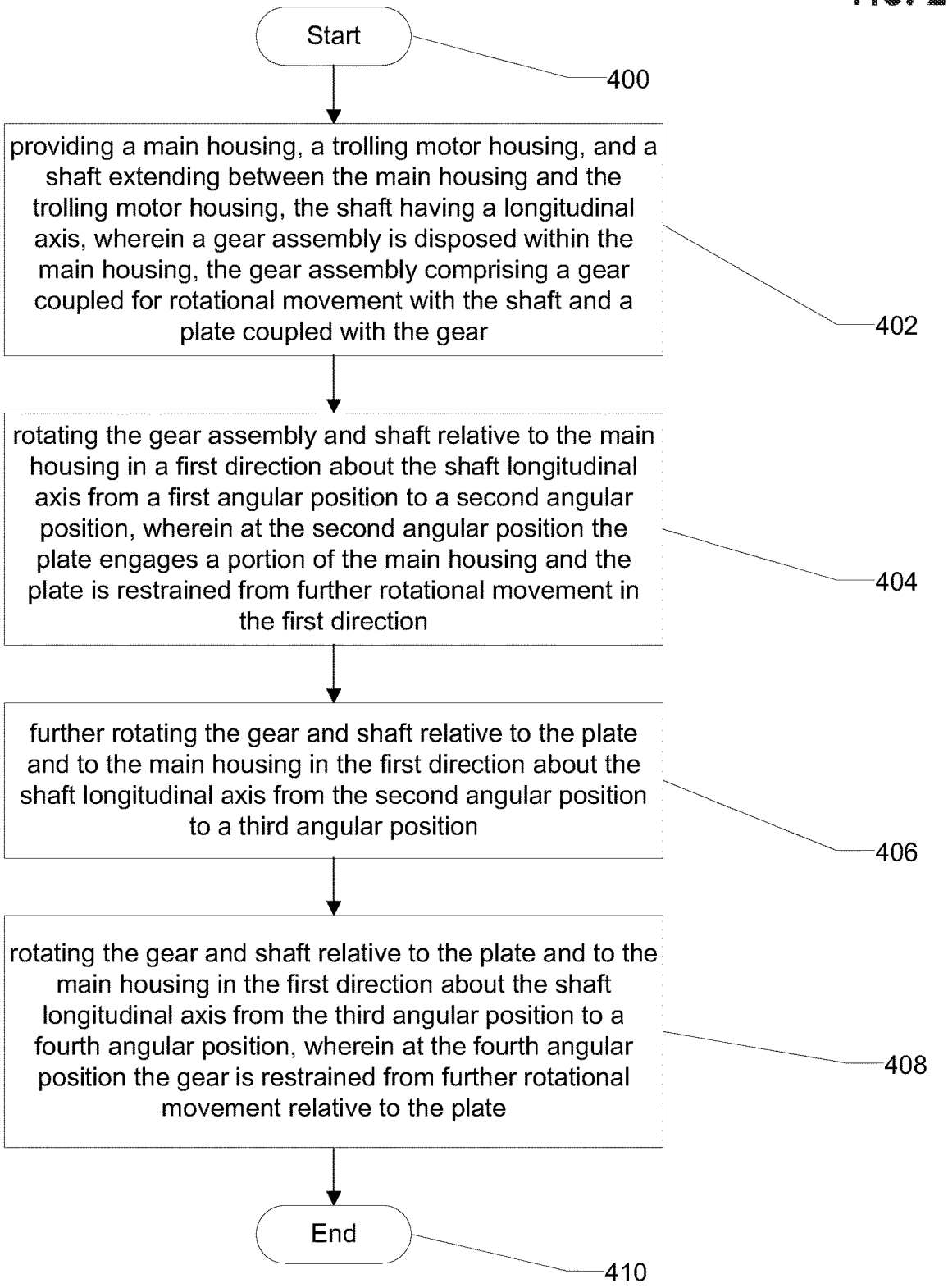
Figure 24:
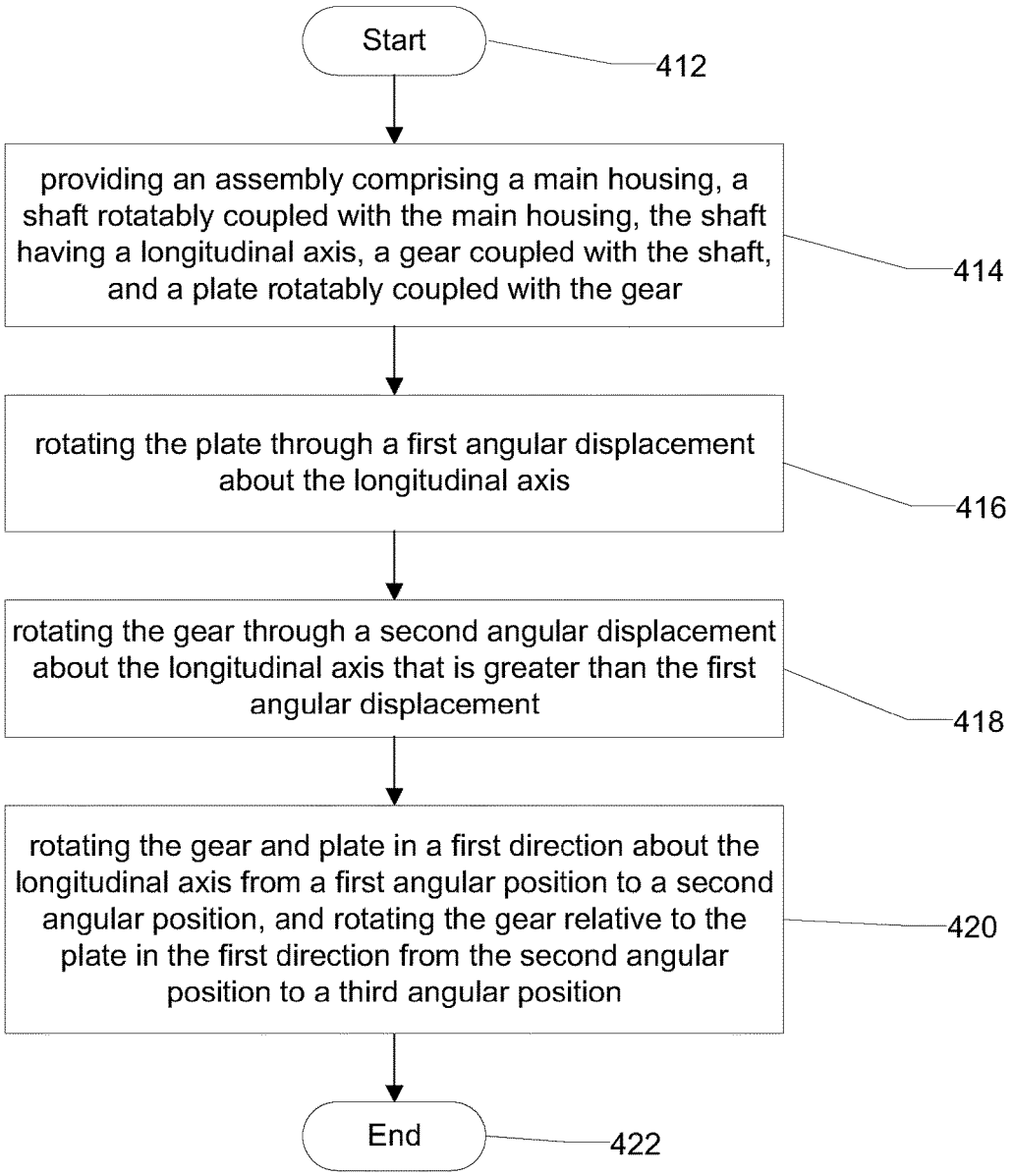
Figure 25:
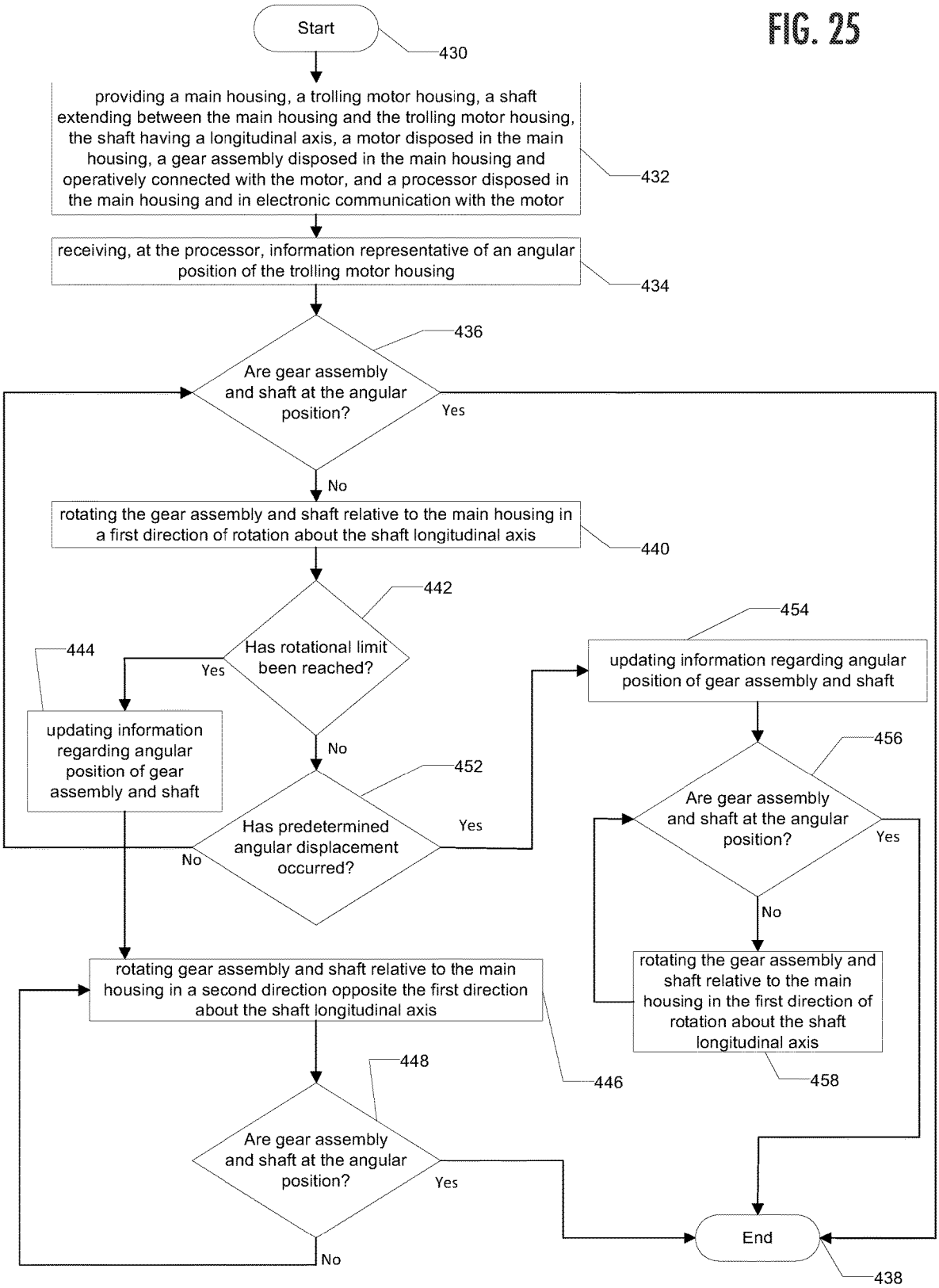

FIG. 14 is a top side plan view of the gear assembly of FIG. 13;

FIG. 15 is a bottom side plan view of the gear assembly of FIG. 13;

FIG. 16 is a bottom side perspective view of the gear assembly of FIG. 13;

FIG. 17 is an elevation view of the gear assembly of FIG. 13;

FIG. 18 is a perspective view of the gear assembly of FIG. 13 coupled with the shaft assembly of FIG. 10 in accordance with an embodiment of the present invention;

FIG. 19 is an enlarged cross-sectional view of the assembly of FIG. 8 wherein the gear assembly and the shaft assembly are in a first position such that the plate is out of engagement with a rib in the main housing;

FIG. 20 is an enlarged cross-sectional view of the assembly of FIG. 8 wherein the gear assembly and the shaft assembly have been rotated to a second position such that the plate is in engagement with the rib in the main housing;

FIG. 21 is an enlarged cross-sectional view of the assembly of FIG. 8 wherein the plate remains in the second position in engagement with the rib in the main housing and wherein the gear and shaft assembly have been rotated to a third position;

FIG. 22 is an enlarged cross-sectional view of the assembly of FIG. 8 wherein the plate remains in the second position in engagement with the rib in the main housing and wherein the gear and shaft assembly have been further rotated to a fourth position;

FIG. 23 is a flowchart of an example method of operating a trolling motor assembly in accordance with an embodiment of the present invention;

FIG. 24 is a flowchart of an example method of operating a trolling motor assembly in accordance with another embodiment of the present invention; and FIG. 25 is a flowchart of an example method of operating a trolling motor assembly in accordance with another embodiment of the present invention.

Repeat use of reference characters in the present specification and drawings is intended to represent same or analogous features or elements of embodiments of the present invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Further, either of the terms "or" and "one of _____ and _____," as used in this disclosure and the appended claims is intended to mean an inclusive "or" rather than an exclusive "or." That is, unless specified otherwise, or clear from the context, either of the phrases "X employs A or B" and "X employs one of A and B" is intended to mean any of the natural inclusive permutations. That is, either phrase is satisfied by any of the following instances: X employs A; X employs B; or X employs both A and B, regardless whether the phrases "at least one of A or B" or "at least one of A and B" are otherwise utilized in the specification or claims. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

FIG. 1 illustrates an example watercraft 10 on a body of water 20. The watercraft 10 has a primary or main propulsion system indicated as motor 12 and a secondary propulsion system indicated as trolling motor assembly 14, which can be attached to, for example, a front portion of the watercraft. The trolling motor assembly 14 can include a trolling motor 16 that is typically submerged in the body of water 20 during use. The trolling motor assembly 14 can be used as a propulsion system to cause the watercraft to travel along the surface of the water 20. While the depicted embodiment shows the trolling motor assembly 14 attached to the front of the watercraft 10 and as a secondary propulsion system, example embodiments described herein contemplate that the trolling motor assembly 14 may be attached in any position or location on the watercraft 10 and/or may be the sole or primary propulsion system for the watercraft 10. Depending on the design and type of the trolling motor assembly 14, the trolling motor 16 may be a fuel-source powered motor (e.g., a gas, diesel, propane, hydrogen, etc. powered motor) or an electric motor. Moreover, steering may be accomplished manually via hand control, via foot control, and/or through use of a remote control. Additionally, in some cases, an autopilot may autonomously operate the trolling motor assembly 14.

Referring now also to FIG. 2, in various embodiments, the trolling motor assembly 14 can be electric and can be controlled by hand through an optional hand control rod 36 or through an optional foot pedal assembly 60. The trolling motor assembly 14 includes a main shaft 22 having a first end 24 coupled to a main housing 30 for housing, among other components, a wireless module, a second end 26 coupled to the trolling motor 16, and a steering assembly 64. The trolling motor 16 also includes a trolling motor housing 28 that is attached to the second end 26 of the shaft 22 and at least partially contains an internal propulsion motor 32 that mechanically and operatively connects to a propeller 34. As shown in FIG. 1, in some embodiments, when the trolling motor 16 of the trolling motor assembly 14 is attached to the watercraft 10 and the associated propulsion motor 32 (or trolling motor housing 28) is submerged in the water, the propulsion motor 32 is configured to propel the watercraft to travel along the body of water 20. In addition to containing the propulsion motor 32, the trolling motor housing 28 may include other additional components, such as, for example, a sonar transducer assembly and/or other sensors or features (e.g., lights, temperature sensors, etc.), as shown in and described with respect to FIG. 3.

The main housing 30 of the trolling motor assembly 14 is connected or attached to the first end 24 of the shaft 22 and can include a hand control rod 36, such as a handle, that enables control of the propulsion motor 32 by a user, such as for example through angular rotation of the shaft 22 and associated housing 30 about axis A1. The main housing 30 can include processing circuitry, such as a processor and associated memory. The processing circuitry may be configured to control the steering assembly 64 based on a current operating mode and to process data received from the trolling motor housing 28, such as for example sonar return data generated by the sonar transducer assembly. In some embodiments, the hand control rod 36 may include a throttle, such as a thumb lever throttle or a rotating hand throttle, that is configured to control the speed of the trolling motor 32. In some embodiments, the trolling motor assembly 14 may be steered remotely using a handheld remote control 70, the foot pedal assembly 60, and/or other remote computing device (such as a remote marine electronics device—e.g., a device used for controlling other features of the watercraft). The illustrated trolling motor assembly 14 can also include an optional foot pedal assembly 60 that is enabled to control operation of the trolling motor assembly 14, as is known in the art.

The trolling motor assembly 14 may also include an attachment device 68 (e.g., a clamp, a mount, or a plurality of fasteners) to enable removable connection or attachment of the trolling motor assembly 14 to the watercraft 10. For example, the attachment device can be a releasable mount for releasably mounting the trolling motor assembly 14 to the watercraft 10. As described in greater detail herein, in various embodiments, certain components of the trolling motor assembly 14, such as housing 28, may be configured for rotational movement relative to the watercraft about the shaft axis A1, including, for example, rotational movement greater than 360 degrees.

The illustrated foot pedal assembly 60 can be electrically connected to the propulsion motor 32 via the main housing 30 by way of a cable 62. The foot pedal assembly 60 enables a user to steer and/or otherwise operate the trolling motor assembly 14 to control the direction and speed of travel of the watercraft 10. In an example embodiment, the foot pedal assembly 60 may provide steering commands, which in turn are used to cause the steering assembly 64 to steer the trolling motor housing 28 about axis A1 in a desired rotational direction. In some embodiments, though not shown, the foot pedal assembly 60 may be connected to the shaft 22 and utilize direct mechanical steering, such as through ropes or wires and the like, to cause steering or movement of the trolling motor housing 28. In still other embodiments, main housing 30 may include a motor operative to rotate shaft 22 about axis A1 in response to the above-mentioned steering commands. In such an embodiment, steering assembly 64 may not be provided. Further, depending upon the configuration of the foot pedal assembly 60, the foot pedal assembly 60 may include an electrical plug 66 that can be connected to an external power source.

Additionally or alternatively, the trolling motor assembly 14 may include a handheld remote control 70. The handheld control 70 may be wired or wirelessly connected to the main housing and provide steering commands, similar to the steering commands discussed above with reference to the foot pedal assembly 60. The handheld remote control 70 can be a dedicated control unit or alternatively can be a control interface executed on a user electronic device, such as for example a tablet computer, a smart phone, a laptop computer and the like.

Certain additional aspects of an example trolling motor assembly are discussed with reference to FIG. 3. As noted above, the trolling motor assembly 14 includes the main housing 30 and a trolling motor housing 28. Trolling motor assembly 14 can include a number of different modules or components, each of which may comprise any device or means embodied in either hardware, software, or a combination of hardware and software, and which are configured to perform one or more corresponding functions. For example, the main housing 30 can include a processor 110, a sonar signal processor 115, a memory 120, a user interface 138, a display 140, and one or more sensors (e.g., position sensor 145). Those of ordinary skill will readily recognize that the sonar signal processor 115 and the processor 110 can be combined into one or more processing components that can be distributed throughout the trolling motor assembly 14. The main housing 30 may also include one or more communication modules configured to communicate with one another in any of a number of different manners as part of a trolling motor communication system 100, including, for example, via a network 102. For instance, a communications element 108 can include a communication interface that includes any of a number of different communication backbones or frameworks. Main housing 30 can also include an electric motor 130 in communication with processor 110 and operative to turn a shaft that is mechanically linked (e.g., via one or more gears and/or other components) to shaft 22, such that the electric motor can cause shaft 22 and trolling motor housing 28 to rotate about axis A1 in response to signals received at processor 110 from a suitable control device, such as remote control 70 or foot pedal assembly 60.

The trolling motor housing 28 may include a trolling propulsion motor 32, a sonar transducer assembly 160, and one or more other sensors 165 (e.g., water temperature, current, etc.), which may each be controlled through the processor 110 as detailed herein. The trolling motor 16 provides the power supplied by the assembly 14 to propel the watercraft along the water. The sonar transducer assembly can be any selected and known sonar transducer assembly for generating sonar return data corresponding to an underwater environment relative to the watercraft. For example, the sonar transducer assembly 160 can employ one or more transducers to interrogate a selected underwater spatial region or area. The sonar transducer assembly is thus configured to transmit sonar signals into the underwater environment, receive sonar returns from the underwater environment, and convert the sonar returns into the sonar return data. The sonar return data is conveyed to one or more of the processors 110, 115 of the main housing 30, which serve to convert the sonar return data into sonar image data. The other sensors can provide any selected additional marine data for use by the trolling motor assembly 14.

The processor 110 and/or the sonar signal processor 115 may be any means configured to execute various programmed operations or instructions stored in memory (e.g., memory 120), such as a device or circuitry operating in accordance with software or otherwise embodied in hardware or a combination of hardware and software (e.g., a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the processor 110 as described herein. In this regard, the processor 110 may be configured to analyze electrical signals communicated thereto to provide marine or sonar data indicative of the size, location, shape, etc. of objects detected by the system 100. For example, one or more of the processors 110, 115 may be configured to receive sonar return data from the sonar transducer assembly 160 and process the sonar return data to generate sonar image data for display to a user, such as via the display 140.

The communication module, such as the Wi-Fi module 108 and any associated communication interface, may be configured to enable connection to external devices and systems, such as for example to the network 102 and to a remote electronic device. In this manner, the processor 110 may retrieve stored data from a remote, external server via the network 102 in addition to or as an alternative to the onboard memory 120. In some embodiments, the sonar image data which is generated by one or more of the processors 110, 115 in the main housing 30 may be wirelessly transmitted via the network 102 by the Wi-Fi module 108 to the remote electronic device. The sonar image data can be displayed on a display unit of the remote electronic device.

In some embodiments, the processor 110 may be further configured to implement signal processing or enhancement features to improve the display characteristics of data or images, collect or process additional data, such as time, temperature, GPS information, waypoint designations, or others, or may filter extraneous data to better analyze the collected data. It may further implement notices and alarms, such as those determined or adjusted by a user, to reflect depth, presence or absence of fish, proximity of other watercraft, and the like. The memory element 120 can be configured to store instructions, computer program code, marine data, and other data associated with the sonar system in a non-transitory computer readable medium for subsequent use, such as by the processors 110, 115.

The position sensor 145 may be configured to determine the current position and/or location of the main housing 30. For example, the position sensor 145 may comprise a GPS or other location detection system. The display 140 may be configured to display images and may include or otherwise be in communication with a user interface 135 configured to receive input from a user. The display 140 may be, for example, a conventional LCD (liquid crystal display), a touch screen display, mobile device, or any other suitable display known in the art upon which images may be displayed. In any of the embodiments, the display 140 may present one or more sets of marine data or images generated from the one or more sets of data, such as from the sonar image data. In some embodiments, the display may be configured to present such marine data simultaneously, for example in split-screen mode. In some embodiments, a user may select any of the possible combinations of the marine data for display. Further, the user interface 135 may include, for example, a keyboard, keypad, function keys, mouse, scrolling device, input/output ports, touch screen, or any other mechanism by which a user may interface with the system.

Various embodiments of the present invention will now be described with reference to FIGS. 4A-25. Referring first to FIGS. 4A-7, views of a main housing 200 of a trolling motor assembly in accordance with one embodiment of the present invention are provided. In this regard, FIG. 4A is a perspective view of main housing 200. As shown, main housing 200 may comprise a first, or upper, portion 202 and a second, or lower, portion 204 that may be coupled together to form an enclosed space 206 (see FIGS. 4B-7). Main housing 200 may be formed from any material suitable for use in a marine environment with which those of skill in the art are familiar, including a suitable plastic material. In some embodiments, for example, portions 202 and 204 may be manufactured from an injection-molded or rotationally-molded plastic material.

As described in more detail herein, various electronic and mechanical components used to operate a trolling motor assembly may be disposed in enclosed space 206. Wiring (e.g., communications and power wires connected with a foot pedal assembly) may extend into enclosed space via a depending connector 208. Also, main housing portion 202 may comprise a rotatable indicator 210 (as shown, for example, comprising a series of arrows 212) that is coupled for rotation with a shaft of the trolling motor assembly and which may indicate to a user the direction in which the propulsion motor is facing.

FIGS. 4B-7 are respective perspective, top side plan, and cross-sectional views of main housing 200 with housing portion 202 removed. Housing portion 204 in this example defines a first aperture 214 and a second aperture 216. As described herein, aperture 214 may be sized to receive one end of a rotatable shaft therein, the other end of which may be coupled with a trolling motor housing. Aperture 216 may be configured to receive depending connector 208. Within enclosed space 206, housing portion 202 may define a recessed area 218 at which a gear assembly and a shaft assembly join together for mutual rotation about a longitudinal axis of the shaft. Other electronic and mechanical components, such as processor(s) (e.g., processors 110, 115), memory (e.g., memory 120), an electric motor operative to turn a shaft (e.g., motor 130), and gear(s) that mate with the gear assembly and which are coupled with the shaft, may be disposed in an adjoining recessed area 220 of enclosed space 206. Those of ordinary skill in the art are familiar with such components and, as such, they are only described generally herein.

In various embodiments, a trolling motor assembly can comprise a rotation-limiting mechanism (e.g., a rotational hardstop) that prevents over-rotation of the assembly's lower unit, including its propulsion motor, but which may allow for rotation of the propulsion motor beyond a single revolution, or 360 degrees. In some embodiments, the rotation-limiting mechanism may comprise a metal plate that is constrained to a controlled and limited "slippage" during rotation. As will be appreciated in view of the present disclosure, such a feature may be particularly desirable in electronically-driven trolling motor, though embodiments of the present invention may be used with cable-driven or hybrid drive trolling motors, too.

Although an example embodiment is shown and described in detail below comprising a rib and tab that interfere within main housing 200 at predetermined angular positions of a gear assembly relative to main housing 200, those of skill in the art will appreciate that the present invention is not so limited. In various example embodiments, the rotation-limiting mechanism may comprise structures other than a rib and tab that cooperate to stop rotational motion of a gear or gear assembly and shaft (and, correspondingly, the assembly's lower unit). Examples include, but are not limited to, a pair of ribs, a pin and socket, a hook and slot, and a detent mechanism. Likewise, in various embodiments, the orientation of a rotation-limiting mechanism may be reversible, in the sense that a structure described as being coupled with or disposed on main housing 200 may instead be disposed on a portion of the gear assembly, and vice versa. Finally, although in one example the rotation-limiting mechanism may comprise a structure disposed on a plate coupled with a gear in main housing 200, it will be appreciated that a similar structure could be disposed on another component that is coupled for rotational movement with the assembly's lower unit, such as but not limited to the shaft. It will be appreciated that all such embodiments are contemplated within the scope of this disclosure.

In this regard, and with continued reference to FIGS. 4B-7, in the illustrated example a rib 222 may be disposed on an interior surface of housing portion 204. Rib 222 preferably is disposed within main housing 200 in a location proximate the shaft and gear assemblies such that rib 222 will interfere with rotation of the gear and/or shaft assemblies at predetermined angular positions thereof about an axis that extends longitudinally along the shaft. As shown, for example, rib 222 extends vertically within area 218 of enclosed space 206 and may be integrally formed with housing portion 204. Rib 222 projects radially inward from a cylindrical wall portion of housing portion 204. As described in more detail below, rib 222 projects inward a distance suitable to interfere with a complementary structure that rotates with the gear and/or shaft assemblies. In one embodiment, rib 222 may have a cross-sectional area that extends over an angle of about six (6) degrees, but thinner and thicker ribs are contemplated. Those of skill in the art will appreciate that rib 222 may be disposed at any angular position about the axis of rotation of the gear assembly and shaft and need not be disposed in the particular angular position shown.

Referring now also to FIGS. 8-18, a trolling motor assembly 230 is shown in part. (To facilitate discussion, certain components of the trolling motor assembly 230 are not shown in these figures, such as the trolling motor housing, main housing portion 202, an attachment device, a foot pedal assembly, and power and communications wiring.) First, FIG. 8 is a perspective view of a gear assembly 232 coupled with a shaft assembly 234 and disposed within main housing 200 in accordance with an embodiment of the present invention. FIG. 9 is an enlarged, partially exploded view of the gear assembly 232, shaft assembly 234, and main housing 200. Shaft assembly 234 and its connection with main housing 200 is described in greater detail below with reference to FIGS. 10-12, and gear assembly 232 and its connection with main housing 200 and shaft assembly 234 is described in greater detail below with reference to FIGS. 13-18.

FIG. 10 is an enlarged, exploded view of a shaft assembly 234 in accordance with an embodiment of the present invention. Shaft assembly 234 in this example comprises a shaft 236 having a proximal end 238 and a distal end 240 (FIG. 8). (As will be appreciated by those of skill in the art, although not shown in the figures, in some embodiments trolling motor assembly 230 may comprise a secondary, or outer shaft, that is stationary (i.e., non-rotational) and which surrounds shaft 236, at least in part. Likewise, although not shown in the figures, a trolling motor housing may be coupled with distal end 240 of shaft 236.) FIG. 11 is a perspective view of main housing portion 204 disposed over proximal end 238 of shaft 236, and FIG. 12 is a perspective view of main housing portion 204 coupled with shaft assembly 234.

In this regard, shaft assembly 234 in this example also comprises first and second collar portions 242, 244 that couple together with shaft 236 at proximal end 238. Each collar portion 242, 244 may be half-circular in shape, though this specific shape is not required, and may each define a pin 246, 248 that extends radially inward therefrom. Pins 246, 248 can be sized for receipt in corresponding apertures 250, 252 defined in shaft 236. When pins 246, 248 are received in apertures 250, 252, opposing faces 254, 256 of collar portions 244, 246 may meet, and apertures 258, 260 defined in each respective collar portion 244, 246 may be in concentric alignment. Collar portions 244, 246 may be secured together with proximal end 238 of shaft 236 via suitable fasteners inserted and secured in apertures 258, 260. Thereby, collar portions are coupled for rotation with shaft 236.

To couple shaft assembly 234 with main housing 200, proximal end 238 of shaft 236 may be inserted through aperture 214 defined in housing portion 204. As shown in FIG. 12, following insertion of shaft 236 in aperture 214, collar portions 242, 244 may be secured on proximal end 238 of shaft 236 as described above. Due to the diameter of collar portions 242, 244 secured together being greater than the diameter of aperture 214, shaft assembly 234 is then rotatably coupled with housing portion 204. Specifically, shaft 236 has a longitudinal axis 262, and in use of trolling motor assembly 230, shaft assembly 234 may rotate about axis 262 in aperture 214 in response to the user's control input, as described in more detail below.

Next, FIG. 13 is an exploded view of gear assembly 232 in accordance with an embodiment of the present invention. FIGS. 14-17 are respective top side plan, bottom side plan, bottom side perspective, and elevation views of gear assembly 232. FIG. 18 is a perspective view of gear assembly 232 coupled with shaft assembly 234 in accordance with an embodiment of the present invention.

Referring first to FIGS. 13-15, gear assembly 232 in this example embodiment comprises a first gear 264 and a plate 266. First gear 264 as shown may be a straight-cut gear and comprise a disc-shaped body member 268 that defines a plurality of radially-extending teeth 270. Those of skill in the art will appreciate, however, that any suitable gear or gear combination may be used, including but not limited to helical and bevel gears, in other embodiments. First gear 264 may be formed of a metal material suitable for use in marine environments, though other materials may be used. In this example, body member 268 also defines a pair of bores 272, 274 dimensioned to receive suitable fasteners therein.

Plate 266 may comprise a thin, annular member 276 in which a pair of slots 278, 280 are defined. In the illustrated embodiment, slots 278, 280 define a curved shape that follows, but is set radially inward from, the circumference of plate 266. Slot 278 may extend between a first end 275 and a second end 277, and slot 280 may extend between a first end 279 and a second end 281. Thus, slots 278, 280 as shown may each have the shape of an arc of a circle having a predetermined angle. In various embodiments, the angle of each of slots 278, 280 may be between about 60 degrees and 120 degrees. In one embodiment, the angle of each of slots 278, 280 may be about one hundred (100) degrees. Other angles are contemplated. In some embodiments, the angle of each of slots 278, 280 may be larger than one hundred (100) degrees. For instance, slots 278, 280 may be oversized to account for the angle of mounting of a trolling motor during installation, i.e., where the motor assembly's mounting position requires that the propulsion motor be rotated relative to the motor head to be in its "neutral" mounting position, which may be parallel with a boat's keel. In such an embodiment, the angle of each of slots 278, 280 may be between about 140 degrees and 160 degrees. As described herein, one of ordinary skill in the art can select a suitable angular length of slots 278, 280 based on the amount by which it is desired that a trolling motor housing be permitted to rotate beyond 360 degrees.

Slots 278, 280 may be disposed symmetrically on plate 266 and may have a width in the radial direction that allows one or more fasteners to move freely along the slots. Plate 266 may be formed of a suitable lightweight metal material, though again other materials may be used. Plate 266 also need not be annular in all embodiments.

Plate 266 in this example is rotatably coupled with first gear 264 via a pair of fasteners 282, 284, which may extend through respective slots 278, 280 and respective bores 272, 274. In this example, plate 266 is coupled to the bottom side, or beneath, first gear 264, but that is not required in all embodiments. In other embodiments, plate 266 may be coupled with the top side, or above, first gear 264. In this embodiment, fasteners 282, 284 comprise shoulder bolts having threaded portions 285. Hex nuts 286, 288 may be positioned in bores 272, 274 (see FIG. 14) and may be threaded onto the shoulder bolts. In general, in this embodiment, shoulder portions 290 of fasteners 282, 284 are received in slots 278, 280, and plate 266 is rotatable relative to first gear 264 through the angular extent of slots 278, 280. Of course, in other embodiments, other suitable fasteners may be used.

Additionally, in this embodiment, first gear 264 defines a central aperture 292, and plate 266 defines a central aperture 294. When first gear 264 and plate 266 are coupled together, apertures 264 and 292 have centers that fall along the same line or axis. Further, in this embodiment, shaft 236 may be hollow and define a central bore 296 (see FIG. 10). When gear assembly 232 is disposed in housing portion 204 and when shaft assembly 234 is coupled with housing portion 204 as described above, the centers of aperture 292 and 294 are also aligned with aperture 214 in housing portion 204 and central bore 296 of shaft 236. In other words, the centers of apertures 292, 294, 214 and the central bore 296 all may fall along the same line or axis. As a result, these apertures and bore may define a path for communications cables and/or other wiring to pass from enclosed space 206 in main housing 200 down to the electronic components in the trolling motor housing that is coupled with the distal end 240 of shaft 236.

In various embodiments, gear assembly 232 is coupled for rotational movement with shaft assembly 234. One such embodiment is described with particular reference to FIGS. 10 and 13-18. As best seen in FIGS. 10 and 18, collar portions 242, 244 may each define a plurality of raised portions 298 disposed on a top surface of each collar portion 242, 244. Collar portions 242, 244 may also each define a bore 300, 302 sized to receive a suitable fastener therethrough.

Similarly, as best seen in FIGS. 16-18, first gear 264 may define a depending stem 304 that may be cylindrical in shape. When plate 266 is coupled with first gear 264, stem 304 passes through central aperture 294. Stem 304 in this example defines a plurality of channels 306. Channels 306 may be dimensioned and positioned to receive raised portions 298 of collar portions 242, 244 therein. In other words, each channel 306 defined in stem 304 may correspond to a raised portion 298 of collar portions 242, 244. As seen in FIG. 18, when collar portions 242, 244 are coupled together, they form a cylindrical shape having a diameter substantially the same as the diameter of stem 304.

As seen in FIGS. 13-15, first gear 264 body portion 268 may have an annular groove 308 defined therein. Within groove 308, two bores 310, 312 may be defined and may extend through stem 304. Stem 304 and the combined collar portions 242, 244 may be brought into engagement with one another such that raised portions 298 are received in channels 306. When these components are brought into engagement, bores 310, 312 are in alignment with bores 300, 302. Via these aligned bores, suitable fasteners may be used to secure first gear 264 with collar portions 242, 244 (and thus, gear assembly 232 with shaft assembly 234). Due to the interlocking nature of the connection between first gear 264 and collar portions 242, 244 in this example, rotation of first gear 264 about the axis of shaft 236 will cause corresponding rotation of shaft assembly 234.

Although the above example contemplates mating engagement between raised portions 298 and slots 306, those of skill in the art will appreciate that other configurations are contemplated and can be used to cause common rotation of gear assembly 232 and shaft assembly 234. Among other structures, for example, in various embodiments complementary teeth may be disposed on the periphery of each of stem 304 and collar portions 242, 244. Likewise, in various embodiments, pins sized to mate with corresponding bores may be disposed on one of stem 304 and collar portions 242, 244, and the corresponding bores may be defined in the other of stem 304 and collar portions 242, 244.

As best seen in FIG. 4A, in some embodiments main housing 200 may comprise a rotatable indicator 210 that is coupled for rotation with shaft 236 and which may indicate to a user the direction in which the propulsion motor is facing. Referring also to FIGS. 13-14, in one embodiment, a second gear 314 may be disposed on body portion 268 of first gear 264. Thus, second gear 314 may rotate with first gear 264. In the illustrated embodiment, second gear 314 may be positioned on body portion 268 at a location radially inward of groove 308 and radially outward of aperture 292. Second gear 314 may be part of a pulley gear arrangement in which a belt is coupled between second gear 314 and a depending portion of indicator 210. Thereby, rotation of first gear 264 and second gear 314 may cause corresponding rotation of indicator 210, and a user may be visually informed of the new orientation of the propulsion motor.

Referring next to FIGS. 13 and 15-18, as noted above, various embodiments of the present invention comprise a rotation-limiting mechanism that both prevents over-rotation of the trolling motor and allows rotation of the trolling motor beyond 360 degrees. In the illustrated embodiment, the rotation-limiting mechanism operates via the rib 222 defined on the interior surface of housing portion 204 and its interaction with plate 266 and first gear 264. In one example embodiment, plate 266 defines a tab 316 which may project from annular member 276 in a direction perpendicular to a plane in which plate 266 lies. Plate 266 may be coupled with first gear 264 such that tab 316 is oriented beneath plate 266 when gear assembly 232 is positioned within main housing 200. As noted above, tab 316 need not extend downward relative to plate 266 in all embodiments, and in other embodiments it may extend at an angle, radially outward or horizontally, or upward relative to plate 266 during operation thereof. Likewise, in various embodiments, tab 316 need not be formed integrally with plate 266.

Tab 316 may be disposed on plate 266 relative to slots 278, 280 such that plate 266 is symmetric about a diameter that extends through the center of tab 316 in one embodiment. Tab 316 may have a first lateral face 318 and a second lateral face 320 that is opposite first lateral face 318. As described below, rotation of first gear 264 in one direction about longitudinal axis 262 will cause corresponding rotation of plate 266 until first lateral face 318 of tab 316 comes into contact with rib 222, and rotation of first gear 264 in the opposite direction about longitudinal axis 262 will cause corresponding rotation of plate 266 until second lateral face 320 comes into contact with rib 222.

Operation of one embodiment of the present invention will be described with reference to FIGS. 19-22, which are enlarged cross-sectional views of trolling motor assembly 230. In FIG. 19, gear assembly 232 and shaft assembly 234 are in a first position such that tab 316 of plate 266 is out of engagement with rib 222. Each subsequent FIG. 20-22 depicts a rotation of gear 264 and shaft assembly 234 in a counterclockwise direction about shaft 236 longitudinal axis 262 from the position shown in FIG. 19 to second (FIG. 20), third (FIG. 21), and fourth (FIG. 22) positions. In FIG. 20, the entire gear assembly 232, including plate 266, has rotated together from the position shown in FIG. 19 to a position at which tab 316 is adjacent rib 222. In FIGS. 21-22, because rib 222 interferes with further rotation of plate 266, plate 266 does not rotate with the rest of gear assembly 232.

More particularly, in some embodiments, a motor (e.g., motor 130) disposed in main housing 200 may be used to cause rotation of gear assembly 232 and shaft assembly 234 in response to a user's control input. In this regard, in one embodiment, one or more sensors (e.g., magnetic sensors) may be disposed in main housing 200 to obtain information regarding the rotation of first gear 264, and this information may be provided to a processor (e.g., processor 110). In one embodiment, the sensor(s) may comprise a rotatable magnet that is coupled with the motor's shaft via a belt or another suitable mechanical linkage. Similarly, a magnetic sensor may be disposed in the foot pedal assembly (e.g., foot pedal assembly 60) and may be used to determine the position of the foot pedal. This information may likewise be provided to the processor.

The motor may be in operative electronic communication with the processor to drive the shaft and gear in response to control input received at the processor. Teeth 270 of first gear 264 may mate with a correspondingly-cut gear that is attached to the shaft turned by the motor. Thus, operation of the motor may rotate the shaft and gear and, by extension, first gear 264, gear assembly 232, and shaft assembly 234.

In one embodiment, when a user changes the position of the foot pedal assembly to indicate a desired change in direction of the propulsion motor, information regarding the position of the foot pedal may be fed to the processor. The processor may cause the motor to operate and rotate the shaft, which may cause rotation of the gear assembly 232, shaft assembly 234, and ultimately the trolling motor housing and propulsion motor as described above. As the shaft rotates, the magnet likewise will rotate, and the sensor may provide information regarding such rotation to the processor as part of a feedback loop. The processor may then use this information to determine the amount by which shaft assembly 234 and the trolling motor housing have rotated to also determine whether the propulsion motor has reached the position indicated by the user, or whether continued operation of the motor is required to rotate the gear assembly 232, shaft assembly 234, and the trolling motor housing to bring the propulsion motor to the position indicated by the user.

In this example embodiment, when gear assembly 232 rotates in a given direction about the shaft 236 longitudinal axis 262, plate 266 rotates with gear 264 and fasteners 282, 284 because the only force acting on plate 266 may be the force of gravity. However, as gear assembly 232 continues to rotate in the given direction, one of the lateral faces 318 or 320 of tab 316 of plate 266 will come into contact with rib 222. (The other lateral face 318 or 320 would contact the rib 222 if the gear assembly 232 were to be rotated in the opposite direction.) At this point, further rotation of first gear 264 would not cause rotation of plate 266, in that rib 222 interferes with tab 316 to prevent further rotation of plate 266. In that situation, plate 266 "slips" relative to the continued rotation of first gear 264. As the first gear 264 continues to rotate relative to plate 266, fasteners 282, 284, which rotate with first gear 264, slide along slots 278, 280. If the first gear 264 is rotated further, such that fasteners 282, 284 reach an end 275, 279 (or 277, 281, depending on the direction of rotation) of slots 278, 280, the slot ends will interfere with further rotation of fasteners 282, 284, and thus of the remainder of gear assembly 232. At this point, the gear assembly 232 will have reached its maximum rotation in that direction.

As will be appreciated, gear assembly 232 may rotate through an angle of nearly 360 degrees between the position at which first lateral face 318 of tab 316 is adjacent rib 222 and the position at which second lateral face 320 of tab 316 is adjacent rib 222. In one embodiment, such an angle may be between about 350 and 358 degrees. In one embodiment, such an angle may be about 354 degrees. In any event, it will also be appreciated that, by virtue of plate 266 and the cooperation of fasteners 282, 284 with slots 278, 280, first gear 264 and shaft assembly 234 (and thus, the propulsion motor) may rotate beyond 360 degrees, but these components are also not able to rotate beyond a predetermined amount, and wiring and internal electronic components are protected from damage that may be caused by over-rotation. In this regard, once a lateral face 318 or 320 of tab 316 encounters rib 222 during rotation in a given direction, first gear 264 may continue to rotate until its fasteners 282, 284 reach a respective end 275, 279 or 277, 281 of slots 278, 280. At that point, further rotation (and, for example, potential damage to wiring) is prevented.

In various embodiments, slots 278, 280 defined in plate 266 may provide up to about 100 degrees of further rotation in the given direction. Thus, in various embodiments, having hit a "hard stop" in a given direction of rotation, first gear 264 and shaft assembly 234 (and, correspondingly, the trolling motor housing) may be able to rotate through an angle of about 460 degrees in the opposite direction before encountering the hard stop again. In some embodiments, first gear 264 and shaft assembly 234 may rotate through +/−230 degrees from a "neutral" position, which may be, for example, a position at which the propulsion motor is parallel with the boat's keel. In some embodiments, first gear 264 and shaft assembly 234 may rotate from the neutral position in one direction through 230 degrees of rotation before hitting the hard stop, and first gear 264 and shaft assembly 234 may rotate from the neutral position in the opposite direction through an angle greater than 230 degrees of rotation (e.g., such as 270 degrees) before hitting the hard stop. In other embodiments, other angular displacements are contemplated. Those of skill in the art can select a suitable slot angle to provide the desired amount of permitted rotation of the trolling motor and to prevent over-rotation. Accordingly, embodiments of the present invention may provide for greater than 360 degrees of rotation while also preventing over-rotation or "free-spin."

FIGS. 20-22 show an example wherein the motor in main housing 200 is operating to cause rotation of the gear assembly 232 and shaft assembly 234 in the counterclockwise direction about longitudinal axis 262 from the position shown in FIG. 19. Specifically, in FIG. 19, tab 316 is spaced apart from rib 222, and fastener 284 in slot 280 of plate 266 is visible. In FIG. 20, gear assembly 232, including plate 266, has rotated in a counterclockwise direction about longitudinal axis 262. Thus, in FIG. 20, fastener 284 is no longer visible. First lateral face 318 of tab 316 is now disposed adjacent rib 222, and slot 278 is visible. Rib 222 will interfere with further rotation of plate 266 in the same counterclockwise direction. In FIG. 21, gear 264 and shaft assembly 234 have continued to rotate in the counterclockwise direction about longitudinal axis 262, but because of the interference between rib 222 and tab 316, plate 266 has remained stationary. As is seen in FIG. 21, however, fastener 282 is now visible, as it has rotated along slot 278. In FIG. 22, gear 264 and shaft assembly 234 have continued to rotate in the counterclockwise direction about longitudinal axis 262, and again plate 266 has remained stationary. Here, though, fastener 282 has reached second end 277 of slot 278, and first gear 264 and shaft assembly 234 cannot be rotated further in the counterclockwise direction. (Although not visible, fastener 284 will also have reached second end 281 of slot 280.) Thus, the trolling motor has reached its rotational limit (e.g., a hard stop) in the counter-clockwise direction, and over-rotation is prevented.

The trolling motor assembly 230 in this example will operate in similar fashion if the motor is operated to turn gear assembly 232 and shaft assembly 234 in the opposite, clockwise direction about longitudinal axis 262 from the position shown in FIG. 22. For example, first gear 264 and plate 266 may initially rotate together. The gear assembly 232 will continue rotate in the clockwise direction until second lateral face 320 engages rib 222, and rib 222 prevents further rotation of plate 266. If the motor continues to be actuated to cause rotation of first gear 264 in the clockwise direction, first gear 264 will continue to rotate relative to plate 266, and fasteners 282, 284 will move along slots 278, 280 away from second ends 277, 281 and toward first ends 275, 279. Rotation beyond 360 degrees in this direction may continue until fasteners 282, 284 reach first ends 275, 279 of slots 278, 280.

As noted above, plate 266 need not be disposed beneath first gear 264 in all embodiments. Likewise, in some embodiments, rather than first gear 264 and plate 266 rotating together until one of the lateral faces of tab 316 encounters rib 222, it is contemplated that, in other embodiments, first gear 264 could first rotate relative to plate 266 until fasteners 282, 284 reach an end 275, 279 or 277, 281 of slots 278, 280. Then, plate 266 and first gear 264 could move together until a side of tab 316 encounters rib 222.

Further, in some embodiments, it is contemplated that software associated with the processor may limit rotation through an angle less than the full possible rotation, such as through 400 degrees of a potential 460 degrees. Thus, in some embodiments, software may limit rotation of the propulsion motor to +1-200 degrees from a position at which the propulsion motor is centered or pointing forward. The processor may execute computer program code which, based on information received from one or more sensors disposed in the main housing, may keep track of the extent to which the propulsion motor has rotated through its available or permitted rotation. In this case, the additional potential (even if not permitted) rotational movement may be used to account for system tolerances. In the absence of rotation occurring when the power is removed from the trolling motor assembly or a software malfunction, a user may never encounter the rotational limit (e.g., hard stop) in such an embodiment.

As noted above, in some embodiments, software running on the processor(s) in the main housing may be able to track the rotation of the gear and shaft assemblies while power is applied to the trolling motor, but it may not be able to track any rotation of these components that may occur while power is not applied to the trolling motor. Thus, if rotation of the gear assembly, shaft assembly, and/or trolling motor housing has occurred while the trolling motor assembly was in the powered off state, when the trolling motor assembly enters a powered-on state, it may not "know" the angular position of these components. Accordingly, it is contemplated that, in various embodiments, after power is reapplied to a trolling motor assembly, the trolling motor assembly may use a rotational limiting mechanism to determine or ascertain the angular position of the gear assembly, shaft assembly, and/or trolling motor housing, even where rotation of such components may have occurred while the trolling motor assembly was in a powered off state. One such embodiment is described in detail below with reference to FIG. 25.

Embodiments of the present invention also provide methods for operating trolling motor assemblies. Various examples of the methods performed in accordance with embodiments of the present invention will now be provided with reference to FIGS. 23-25. The operations illustrated in and described with respect to FIGS. 23-25 may, for example, be performed by, with the assistance of, and/or under the control of one or more of the processor 110, sonar signal processor 115, memory 120, communications element 108, position sensor 145, user interface 138, display 140, motor 130, foot pedal assembly 60, and/or remote control 70 or another user device.

First, FIG. 23 is a flowchart according to example methods for operating a trolling motor assembly according to an example embodiment. At operation 400, the process starts. At operation 402, provided are a main housing, a trolling motor housing, and a shaft extending between the main housing and the trolling motor housing, the shaft having a longitudinal axis. Also provided is a gear assembly is disposed within the main housing, the gear assembly comprising a gear coupled for rotational movement with the shaft and a plate coupled with the gear. Next, at operation 404, the gear assembly and shaft are rotated relative to the main housing in a first direction about the shaft longitudinal axis from a first angular position to a second angular position, wherein at the second angular position the plate engages a portion of the main housing and the plate is restrained from further rotational movement in the first direction. Then, at operation 406, the gear and shaft are further rotated relative to the plate and to the main housing in the first direction about the shaft longitudinal axis from the second angular position to a third angular position. At operation 408, the gear and shaft are rotated relative to the plate and to the main housing in the first direction about the shaft longitudinal axis from the third angular position to a fourth angular position, wherein at the fourth angular position the gear is restrained from further rotational movement relative to the plate At operation 410, the process ends.

FIG. 24 is a flowchart according to example methods for operating a trolling motor assembly according to another example embodiment. At operation 412, the process starts. At operation 414, provided are an assembly comprising a main housing, a shaft rotatably coupled with the main housing, the shaft having a longitudinal axis, a gear coupled with the shaft, and a plate rotatably coupled with the gear. At operation 416, the plate is rotated through a first angular displacement about the longitudinal axis. At operation 418, the gear is rotated through a second angular displacement about the longitudinal axis that is greater than the first angular displacement. At operation 420, the gear and plate are rotated in a first direction about the longitudinal axis from a first angular position to a second angular position, and the gear is rotated relative to the plate in the first direction from the second angular position to a third angular position. At operation 422, the process ends.

FIG. 25 is a flowchart according to example methods for operating a trolling motor assembly according to another example embodiment. At operation 430, the process starts. In some embodiments, the process starts once power is applied to the trolling motor assembly such that it enters a powered-on state from a powered-off state. At operation 432, provided are a main housing, a trolling motor housing, a shaft extending between the main housing and the trolling motor housing, the shaft having a longitudinal axis, a motor disposed in the main housing, a gear assembly disposed in the main housing and operatively connected with the motor, and a processor disposed in the main housing and in electronic communication with the motor. As discussed above, the processor may be in communication with one or more sensors disposed in the main housing and which are operative to provide information to the processor regarding rotation of the gear assembly and/or shaft. From this information, the processor may determine the angular position of the trolling motor housing and/or propulsion motor relative to a predetermined angular position (e.g., when the trolling motor is facing forward, the processor may arbitrarily assign this location an angular position of 0 degrees; alternatively, the predetermined angular position may be 180 degrees from the center of a rib disposed on the main housing). This information may be stored and updated in nonvolatile memory so that it may be accessed in the event of power loss. However, and particularly in the case that the trolling motor assembly has entered a powered-on state from a powered-off state and rotation of the trolling motor housing and/or propulsion motor has occurred while the trolling motor assembly was in the powered-off state, the angular position of the trolling motor housing and/or propulsion motor as determined by the processor might be incorrect. In various embodiments, at any time or at least initially after powering-on, the processor may use information regarding the amount of rotation that is able to, or does, occur and/or information regarding whether a rotational limit is encountered in an unexpected angular position to recalibrate itself (e.g., by repositioning the trolling motor housing) and/or by updating its information regarding the current angular position of the trolling motor housing.

In this regard, at operation 434, the processor receives information representative of an angular position of the trolling motor housing. For example, this information may be communicated to the processor from the foot pedal assembly, and it may be based on a user's manipulation of the foot pedal assembly to cause rotation of the propulsion motor to a desired position. At operation 436, the processor may determine whether the gear assembly and shaft are at the angular position. If so, the process ends at operation 438.

If not, at operation 440, the gear assembly and shaft are rotated relative to the main housing in a first direction of rotation about the shaft longitudinal axis. The first direction of rotation about the shaft longitudinal axis may be a direction of rotation that corresponds to a steering direction indicated by the user. More particularly, in one embodiment, if the processor has recently entered a powered-on state and/or if it has not recently recalibrated the information it has regarding the angular location of the trolling motor housing and/or propulsion motor, the processor may initially, or provisionally, operate on the assumption that its information regarding the angular position of the trolling motor housing is correct. The processor may operate in this manner until it confirms that its information is correct or until it obtains updated information, as described herein. Thus, at least initially, the processor will cause the motor to turn the gear assembly, and thus the trolling motor housing, in the direction indicated by the user as long as the processor determines that there is enough "available" rotation to reach the desired angular position by causing rotation in that direction.

At operation 442, the processor may determine whether a rotational limit has been reached. For example, the processor may use information from the one or more sensor(s) in the main housing to determine that rotational movement in the direction of rotation is not occurring despite instructions for the motor to operate. Alternatively, the processor may receive a signal from or measure an electrical characteristic (e.g., current, resistance, etc.) of the motor to determine that a rotational limit has been reached.

If a rotational limit has been reached, the processor may determine that the information it has regarding the angular location of the trolling motor housing and/or propulsion motor is incorrect. In various embodiments, this may be because the processor has reached a rotational limit in an unexpected position. For instance, the processor knows the angular position at which it should encounter the rotational limit, and if its information regarding the angular location of the trolling motor housing and/or propulsion motor had been correct prior to operation 434 (i.e., prior to receiving information representative of the angular position of the trolling motor housing), the processor would have caused rotation of the gear assembly and shaft in the opposite direction than that indicated by the user so that it would not encounter the rotational limit. Thus, the processor may use the rotational limit to determine and/or recalibrate information regarding the angular position of the trolling motor housing.

As such, at operation 444, the processor may update its information regarding the angular position of the gear assembly and shaft (and thus, the trolling motor housing). At operation 446, the processor may cause rotation of the gear assembly and shaft in a second direction opposite the first direction of rotation about the shaft longitudinal axis. In one embodiment, the processor may cause the gear assembly and shaft (and thus, the trolling motor housing) to quickly turn a predetermined angular amount, such as 180 degrees, in the second direction, and then may keep causing rotation in that second direction. At operation 448, the processor may determine whether the gear assembly and shaft have reached the angular position. If not, at operation 450, the process may return to operation 446. If so, the process may end at operation 438.

Returning to operation 442, if a rotational limit has not been reached, then at operation 452, the processor may determine whether a predetermined angular displacement of the gear assembly and shaft has occurred. More particularly, if the processor knows that it has been able to cause rotation of the gear assembly and shaft through at least a predetermined angular displacement, then it may use this information to confirm that it its information regarding the angular position of the gear assembly and shaft (and thus, the trolling motor housing) is correct, at least within system tolerances. In various embodiments, the predetermined angular displacement may be determined based on angular position information stored in memory (e.g., the last known angular position of the gear assembly and shaft) when the trolling motor assembly is returned to a powered-on state. In various other embodiments, the predetermined angular displacement may be about 120 degrees. In any event, at operation 454, the processor may update or confirm its information regarding the angular position of the gear assembly and shaft (and thus, the trolling motor housing).

Next, at operation 456, the processor may determine whether the gear assembly and shaft are at the desired angular position. If so, the process ends at step 438. If not, at operation 458, the processor may continue to cause rotation of the gear assembly and shaft relative to the main housing in the first direction about the shaft longitudinal axis. The process may then return to operation 456 and may continue to loop until it is determined at operation 456 that the gear assembly and shaft have reached the desired angular position.

Based on the foregoing, it will be appreciated that embodiments of the invention provide improved trolling motor assemblies and systems and methods for operating a trolling motor. Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. A method of operating a trolling motor assembly for a watercraft, the method comprising:

providing the trolling motor assembly, wherein the trolling motor assembly comprises:

a main housing;

a trolling motor housing;

a shaft extending between the main housing and the trolling motor housing, the shaft having a longitudinal axis and being rotationally connected to the trolling motor housing;

a steering motor operatively connected to the shaft and configured to control a direction of rotation of the shaft and the trolling motor housing relative to the watercraft; and one or more processors in electronic communication with the steering motor;

receiving, at the processor, information representative of an angular position of the trolling motor housing;

rotating the shaft and the trolling motor housing relative to the watercraft in a first direction of rotation about the longitudinal axis of the shaft;

determining whether a limit on rotation of the shaft and the trolling motor housing in the first direction of rotation has been reached; and rotating the shaft and the trolling motor housing relative to the watercraft in a second direction of rotation opposite the first direction of rotation about the longitudinal axis of the shaft.

2. The method of claim 1, further comprising determining whether the trolling motor housing is at the angular position.

3. The method of claim 1, further comprising updating information regarding the angular position of the trolling motor housing if it is determined that the limit on rotation of the shaft and the trolling motor housing relative to the watercraft in the first direction of rotation has been reached.

4. The method of claim 3, further comprising continuing to rotate the shaft and the trolling motor housing relative to the watercraft in the second direction opposite the first direction about the longitudinal axis of the shaft until the shaft and the trolling motor housing are at the angular position.

5. The method of claim 3, further comprising continuing to rotate the shaft and the trolling motor housing by causing the shaft and the trolling motor housing to rotate a predetermined angular amount in the second direction and then continuing to rotate the shaft and the trolling motor housing relative to the watercraft in the second direction opposite the first direction about the longitudinal axis of the shaft until the shaft and the trolling motor housing are at the angular position.

6. The method of claim 1, wherein the angular position is an expected angular position, wherein the method further comprises determining a current angular position of the trolling motor housing and determining if there is a difference between the current angular position and the expected angular position.

7. The method of claim 6, further comprising updating information regarding the angular position of the trolling motor housing based on the current angular position.

8. The method of claim 6, further comprising continuing to rotate the shaft and the trolling motor housing relative to the watercraft in either the first direction of rotation or the second direction of rotation about the longitudinal axis of the shaft until the trolling motor housing is at the expected angular position.

9. The method of claim 1, wherein determining the limit on rotation comprises determining that at least one of the shaft, the trolling motor housing, or a part thereon has contacted a rib projecting from the main housing, wherein the rib projects into a path of rotation at a position along the path of rotation that corresponds with the limit on rotation.

10. The method of claim 1, further comprising a gear assembly disposed in the main housing and operatively connected with the steering motor, wherein the steering motor is further configured to cause the shaft and a gear of the gear assembly to rotate relative to the main housing.

11. A trolling motor assembly for a watercraft comprising:

a main housing;

a trolling motor housing;

a shaft extending between the main housing and the trolling motor housing, the shaft having a longitudinal axis and being rotationally connected to the trolling motor housing;

a steering motor operatively connected to the shaft and configured to control a direction of rotation of the shaft and the trolling motor housing relative to the watercraft; and one or more processors in electronic communication with the steering motor;

a memory including computer program code configured to, when executed, cause the one or more processors to:

receive information representative of an angular position of the trolling motor housing, cause operation of the steering motor to cause rotation of the shaft and the trolling motor housing relative to the watercraft in a first direction about the longitudinal axis of the shaft, determine whether a limit on rotation of the shaft and the trolling motor housing in the first direction of rotation has been reached, and cause operation of the steering motor to cause rotation of the shaft and the trolling motor housing relative to the watercraft in a second direction of rotation opposite the first direction of rotation about the longitudinal axis of the shaft.

12. The trolling motor assembly of claim 11, wherein the memory including computer program code is further configured to, when executed, cause the one or more processors to determine whether the trolling motor housing is at the angular position.

13. The trolling motor assembly of claim 11, wherein the memory including computer program code is further configured to, when executed, cause the one or more processors to update information regarding the angular position of the trolling motor housing if it is determined that the limit on rotation of the shaft and the trolling motor housing relative to the watercraft in the first direction of rotation has been reached.

14. The trolling motor assembly of claim 13, wherein the memory including computer program code is further configured to, when executed, cause the one or more processors to continue to rotate the shaft and the trolling motor housing relative to the watercraft in the second direction opposite the first direction about the longitudinal axis of the shaft until the shaft and the trolling motor housing are at the angular position.

15. The trolling motor assembly of claim 13, wherein the memory including computer program code is further configured to, when executed, cause the one or more processors to continue to rotate the shaft and the trolling motor housing by causing a rotation at a predetermined angular amount in the second direction and then continuing to rotate the shaft and the trolling motor housing relative to the watercraft in the second direction opposite the first direction about the longitudinal axis of the shaft until the shaft and the trolling motor housing are at the angular position.

16. The trolling motor assembly of claim 11, wherein the angular position is an expected angular position, and wherein the memory including computer program code is further configured to, when executed, cause the one or more processors to determine a current angular position of the trolling motor housing and determine if there is a difference between the current angular position and the expected angular position.

17. The trolling motor assembly of claim 16, wherein the memory including computer program code is further configured to, when executed, cause the one or more processors to update information regarding the angular position of the trolling motor housing based on the current angular position.

18. The trolling motor assembly of claim 16, wherein the memory including computer program code is further configured to, when executed, cause the one or more processors to rotate the shaft and the trolling motor housing relative to the watercraft in either the first direction of rotation or the second direction of rotation about the longitudinal axis of the shaft until the trolling motor housing is at the expected angular position.

19. The trolling motor assembly of claim 11, further comprising a gear assembly disposed in the main housing and operatively connected with the steering motor, wherein the steering motor is further configured to cause the shaft and a gear of the gear assembly to rotate relative to the main housing.

20. A non-transitory computer-readable medium comprised of at least one memory device having computer program instructions stored thereon, the computer program instructions being configured, when executed by a processor, to:

receive information representative of an angular position of a trolling motor housing, cause operation of a steering motor to cause rotation of a shaft and the trolling motor housing relative to a watercraft in a first direction about a longitudinal axis of the shaft, determine whether a limit on rotation of the shaft and the trolling motor housing relative to the watercraft in the first direction of rotation has been reached, and cause operation of the steering motor to cause rotation of the shaft and the trolling motor housing relative to the watercraft in a second direction of rotation opposite the first direction of rotation about the longitudinal axis of the shaft.

* * * * *